US007238147B2

(12) United States Patent
Mills et al.

(10) Patent No.: US 7,238,147 B2
(45) Date of Patent: Jul. 3, 2007

(54) EXERCISE DEVICE WITH REMOVABLE WEIGHT

(75) Inventors: Alden Morris Mills, Larkspur, CA (US); Mark B. Friedman, Simi Valley, CA (US); Stephen G. Hauser, Tarzana, CA (US); William Patrick Conley, Santa Monica, CA (US); Rodger Dale Thomason, Santa Monica, CA (US)

(73) Assignee: PT Metrics, LLC, Simi Valley, CA (US)

( * ) Notice: Subject to any disclaimer, the term of this patent is extended or adjusted under 35 U.S.C. 154(b) by 0 days.

(21) Appl. No.: 11/016,866

(22) Filed: Dec. 21, 2004

(65) Prior Publication Data

US 2005/0227831 A1 Oct. 13, 2005

Related U.S. Application Data

(63) Continuation-in-part of application No. 10/819,116, filed on Apr. 7, 2004.

(51) Int. Cl.
*A63B 21/075* (2006.01)
*A63B 21/00* (2006.01)
*A63B 21/06* (2006.01)

(52) U.S. Cl. ..... 482/106; 482/92; 482/93

(58) Field of Classification Search ..... 482/93, 482/106, 110, 123, 94, 105, 107–109, 44, 482/46, 49, 50; 16/DIG. 8
See application file for complete search history.

(56) References Cited

U.S. PATENT DOCUMENTS

| | | | | |
|---|---|---|---|---|
| 4,529,198 | A * | 7/1985 | Hettick, Jr. | 482/104 |
| 4,645,204 | A * | 2/1987 | Berger | 482/123 |
| 4,743,017 | A | 5/1988 | Jaeger | |
| 5,080,349 | A * | 1/1992 | Vittone | 482/106 |
| 5,211,616 | A * | 5/1993 | Riley, Jr. | 482/106 |
| 5,393,285 | A * | 2/1995 | Fischer et al. | 482/108 |
| 5,407,405 | A | 4/1995 | Oren | |
| 5,716,305 | A * | 2/1998 | Selsam | 482/93 |
| 5,735,779 | A * | 4/1998 | Lay | 482/93 |
| 5,967,948 | A * | 10/1999 | Carr | 482/93 |
| 6,083,144 | A | 7/2000 | Towley, III et al. | |
| 6,286,146 | B1 * | 9/2001 | Rocker | 2/94 |
| 6,338,702 | B1 * | 1/2002 | Jordan | 482/108 |
| 6,485,399 | B2 * | 11/2002 | Greene | 482/106 |
| 6,981,933 | B2 * | 1/2006 | Scafidel | 482/110 |
| 2003/0134716 | A1 * | 7/2003 | Yu | 482/44 |

OTHER PUBLICATIONS

International Search Report dated Aug. 29, 2006.

* cited by examiner

*Primary Examiner*—Stephen R. Crow
*Assistant Examiner*—Arun Chhabra
(74) *Attorney, Agent, or Firm*—Harness, Dickey & Pierce, P.L.C.

(57) ABSTRACT

An exercise device in which removable weight may be provided in a housing of the device. Two rotatable handles may be provided in the housing, permitting various hand orientations during exercise. The removable weight may be received within and/or removed from a cavity of the device.

19 Claims, 28 Drawing Sheets

EXERCISE DEVICE WITH REMOVABLE WEIGHT

PRIORITY STATEMENT AND CONTINUATION INFORMATION

This application is a continuation-in-part of, and claims domestic priority benefits under 35 U.S.C. §120 to, co-pending U.S. patent application Ser. No. 10/819,116 to Alden M. Mills et al., filed Apr. 7, 2004 and entitled "EXERCISE DEVICE, METHOD OF FABRICATING EXERCISE DEVICE, AND METHOD AND SYSTEM FOR INTERACTION WITH AN EXERCISE DEVICE", the entire contents of which is incorporated by reference herein.

BACKGROUND OF THE INVENTION

1. Field of the Invention

The present invention generally relates to an exercise device, a method of fabricating the device, and a method and system for interaction with an exercise device.

2. Description of Related Art

Today, dumbbells may be generally recognized as the most efficient of strength training devices. They allow extreme flexibility in patterns of movement and allow the athlete to perform a real world training regimen unlike, for example, bungee cord exercises. Therapists prefer dumbbells because dumbbells may reflect everyday movements and the flexibility of a dumbbell may allow the patient to train around joint and muscle trauma. People that train with dumbbells may enjoy productive gains not available with other training modalities because dumbbells generally require balance and involve synergistic muscle groups to contract during the lift. The necessity to balance the dumbbells and coordinate movement of each hand may stress the muscular and nervous system unlike any machine exercise. With machines, a portion of the athlete's musculature can actually relax due to the absence of fully balanced coordination, i.e. one side can push harder than the other.

There are two basic forms of dumbbells: fixed or "pro-style", and adjustable dumbbells. Fixed dumbbells are individually compact, but are typically sold in sets which typically may be stored on a rack that is bulky and cumbersome. Adjustable dumbbells have historically incorporated plates and locking collars secured to the ends of an extended handle.

Adjustable dumbbells may be the most space and cost efficient exercise equipment. However, adjustable dumbbells may have some drawbacks. One drawback may be the time it takes to change or adjust both dumbbells. Removing and replacing the locking collars and plates may be time consuming, and can be a potential safety hazard if the collars are not securely tightened. Some exercises such as bench presses, inclines and shoulder work typically begin and end with the dumbbells resting on the knees of the user. However, this may be unwieldy and painful if the ends of the dumbbells are not relatively flat.

Various adjustable dumbbells have been developed heretofore. U.S. Pat. No. 4,743,017 to Jaeger, U.S. Pat. No. 4,529,198 to Hettick and U.S. Pat. No. 6,083,144 to Towley, III et al. are representative of the prior art in this regard. Each of these patents, however, addresses only certain aspects of an adjustable dumbbell, such as releasability, interlocking of the weights, etc. Moreover, the exercise devices in each of these references may involve a relatively cumbersome operation to add and/or subtract weight and/or may be somewhat bulky and cumbersome to store.

SUMMARY OF THE INVENTION

An exemplary embodiment of the present invention is directed to an exercise device which may include a housing and a pair of rotatable handle assemblies. The housing may include a cavity for receiving one or more removable weights.

Another exemplary embodiment of the present invention is directed to an exercise device that includes the housing, handle assemblies and a cavity for securing removable weight therein. The cavity may be provided between the handle assemblies. The device may include one or more weight release mechanisms for selectively releasing weights secured within the cavity.

Another exemplary embodiment of the present invention is directed to an exercise device that includes the housing, handle assemblies and cavity between the handle assemblies for securing removable weight therein. The device includes a plurality of weights sockets within the cavity, where each weight socket may be configured for retaining a corresponding weight therein.

BRIEF DESCRIPTION OF THE DRAWINGS

Exemplary embodiments of the present invention will become more fully understood from the detailed description given herein below and the accompanying drawings, wherein like elements are represented by like reference numerals, which are given by way of illustration only and thus do not limit the exemplary embodiments of the present invention.

DETAILED DESCRIPTION OF THE EXEMPLARY EMBODIMENTS

In general, the exemplary embodiments of the present invention introduce an exercise device for providing removable weight in a housing of the device. Two rotating handles may be provided in the housing, permitting various hand orientations during exercise. Unlike most dumbbell-type free-weight devices, the removable weight may be provided near the center of the exercise device, with the handles substantially outboard the removable weight.

Figure 1:
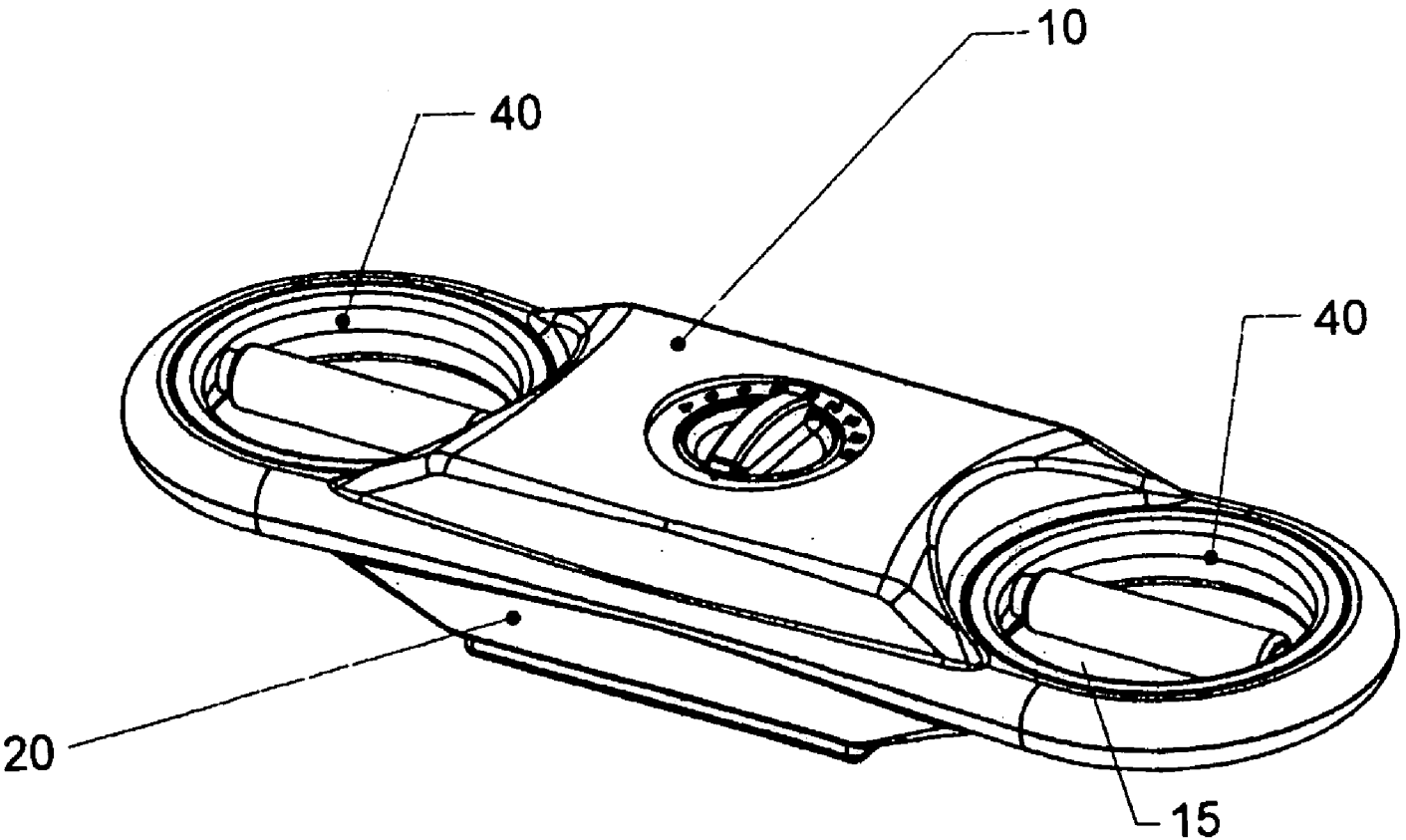
FIG. 1 is a plan view of an exercise device in accordance with an exemplary embodiment of the present invention.
Figure 2A:
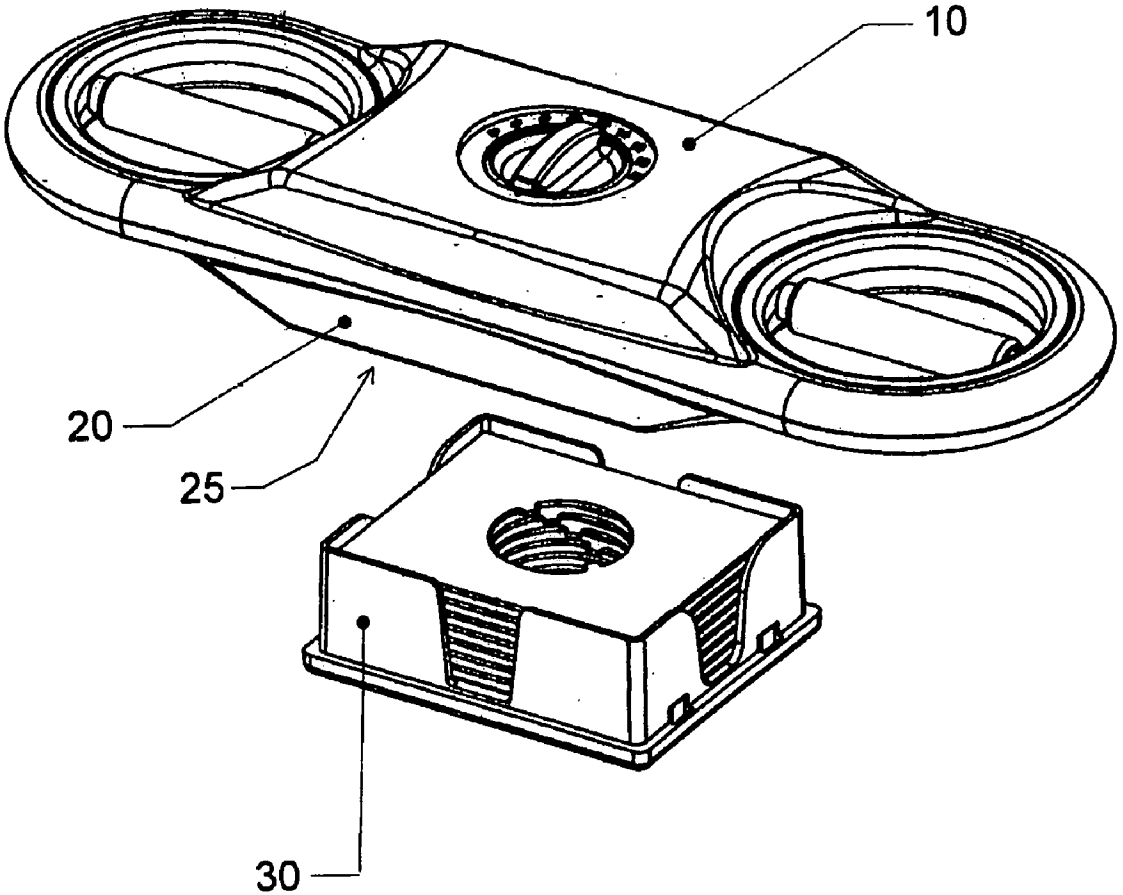
FIG. 2A is an extended plan view of FIG. 1 illustrating a removable tray in accordance with an exemplary embodiment of the present invention.
Figure 2B:
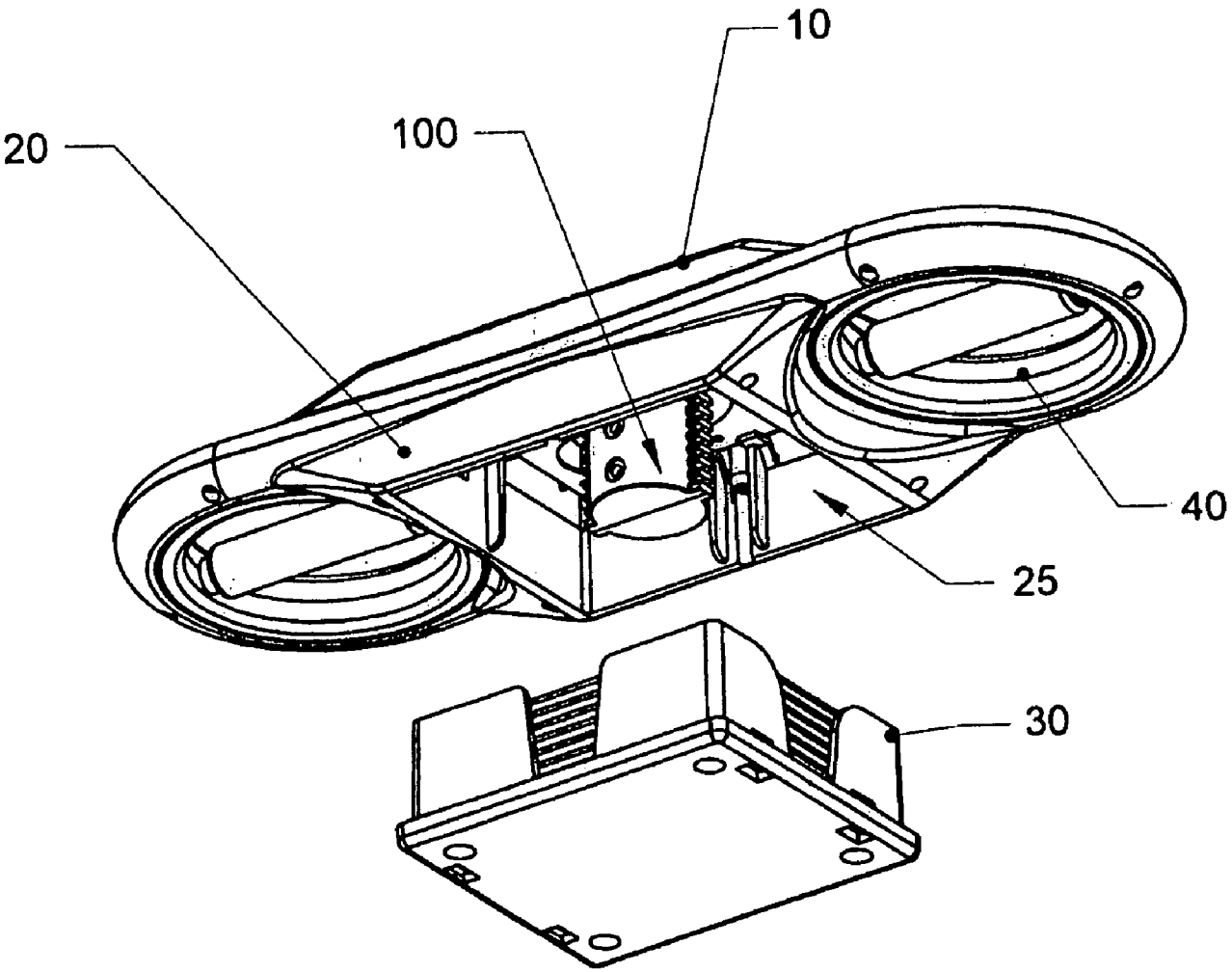
FIG. 2B is an underside view of FIG. 1 illustrating a cavity of the lower housing of the exercise device, in accordance with an exemplary embodiment of the present invention.

FIG. 1 is a plan view of an exercise device in accordance with an exemplary embodiment of the invention and FIGS. 2A and 2B are an extended plan view and underside view of FIG. 1 illustrating a removable tray and a cavity of the lower housing in accordance with an exemplary embodiment of the invention. Referring to FIG. 1, the exercise device 1 may include an upper housing 10 and a lower housing 20. Rotating handle assemblies 40 may be provided within openings 15 provided in the upper housing 10 and lower housing 20.

Referring to FIG. 2A, a tray 30 is shown in relation to the upper housing 10 and lower housing 20. Referring to FIG. 2B, lower housing 20 may be provided within a cavity at an underside (indicated generally by arrow 25), allowing tray 30 and its contents to dock or be inserted within the exercise device 1 for tray storage or weight change via a weight selector assembly 100. It is evident to those skilled in the art that tray 30 may be configured in one or more alternative yet equivalent structural forms or shapes for holding and/or storing weight plates 300, as opposed to the exemplary configuration shown in FIG. 2B, for example.

Figure 3:
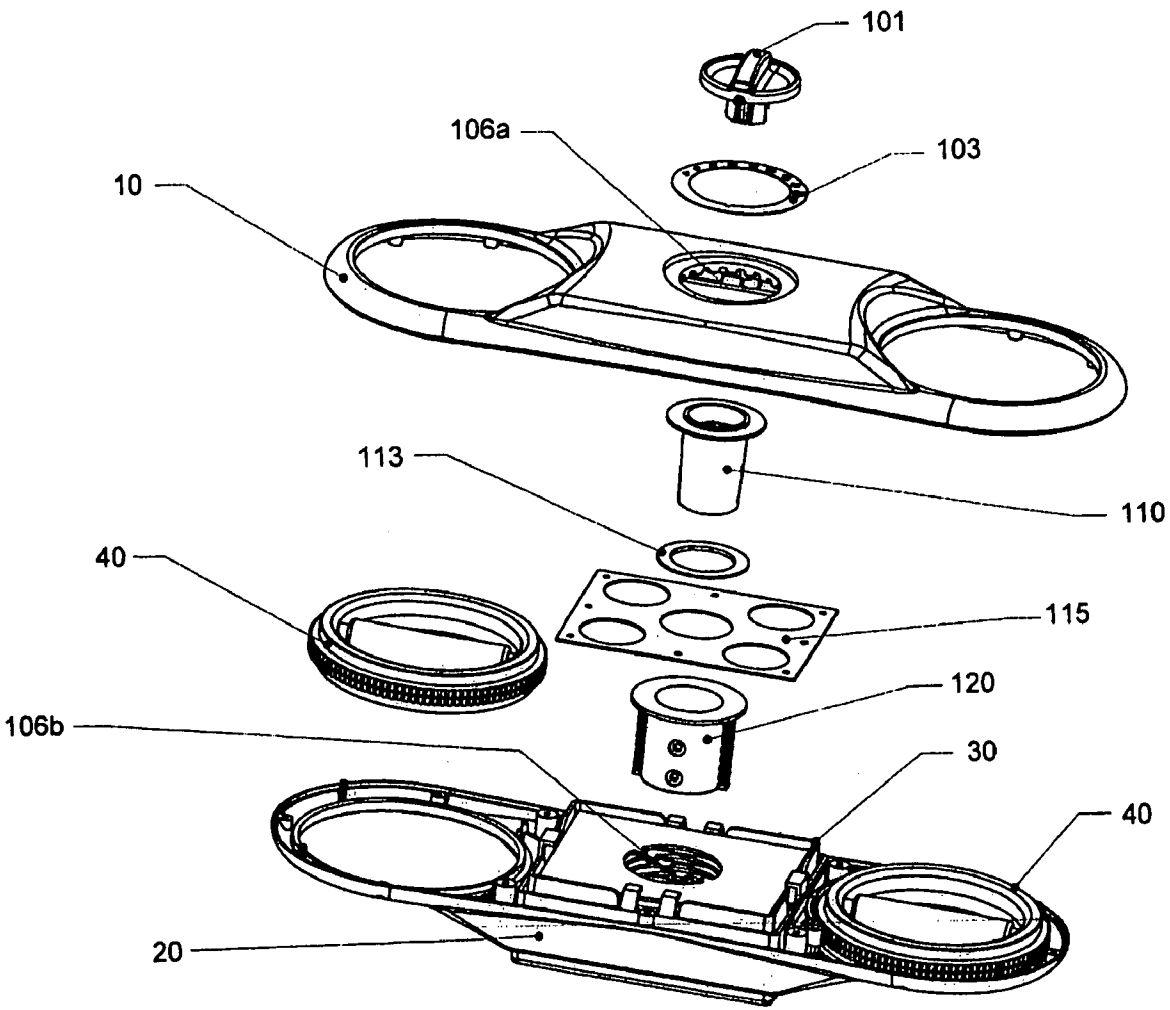
FIG. 3 is an exploded view of an exercise device in accordance with an exemplary embodiment of the present invention.

FIG. 3 is an exploded view of the exercise device 1 in accordance with an exemplary embodiment of the invention. Tray 30 may be docked inside lower housing 20. As shown in FIG. 3, the method by which handle assemblies 40 may be mounted between upper housing 10 and lower housing 20 is visible.

Additionally in FIG. 3, a weight selection assembly 100 is shown in exploded view. The weight selection assembly 100 may include at least a selector knob 101, an inner selector tube 110, and an outer selector tube 120. Selector knob 101 may be provided on the outside of upper housing 10 and may extend through a central opening 106*a* in upper housing 10, as shown in FIG. 3. Selector knob 101 engages inner selector tube 110 to form a rotatable subassembly 101–110, for example. Inner selector tube 110 passes through the support plate 115. The support plate 115 may be rigidly fixed to upper housing 10 for providing support for the subassembly 101–110, while allowing the subassembly 101–110 to rotate.

A friction washer 113 (which may be composed of a suitable metal, rubber or plastic material) may be interposed between inner selector tube 110 and support plate 115, providing a durable wear surface. Below support plate 115, the subassembly 101–110 may be rigidly connected to the outer selector tube 120, which may extend into a lower central opening 106*b* in lower housing 20. Lower central opening 106*b* provides weight selector assembly 100 access into cavity 25. Thus, rotational input to selector knob 100 may be transmitted through the subassembly 101–110 to outer selector tube 120, while the weight selection assembly 100 (outer selector tube 120, inner selector tube 110 and selector knob 101) is supported by upper housing 10 through support plate 105.

Figure 4:
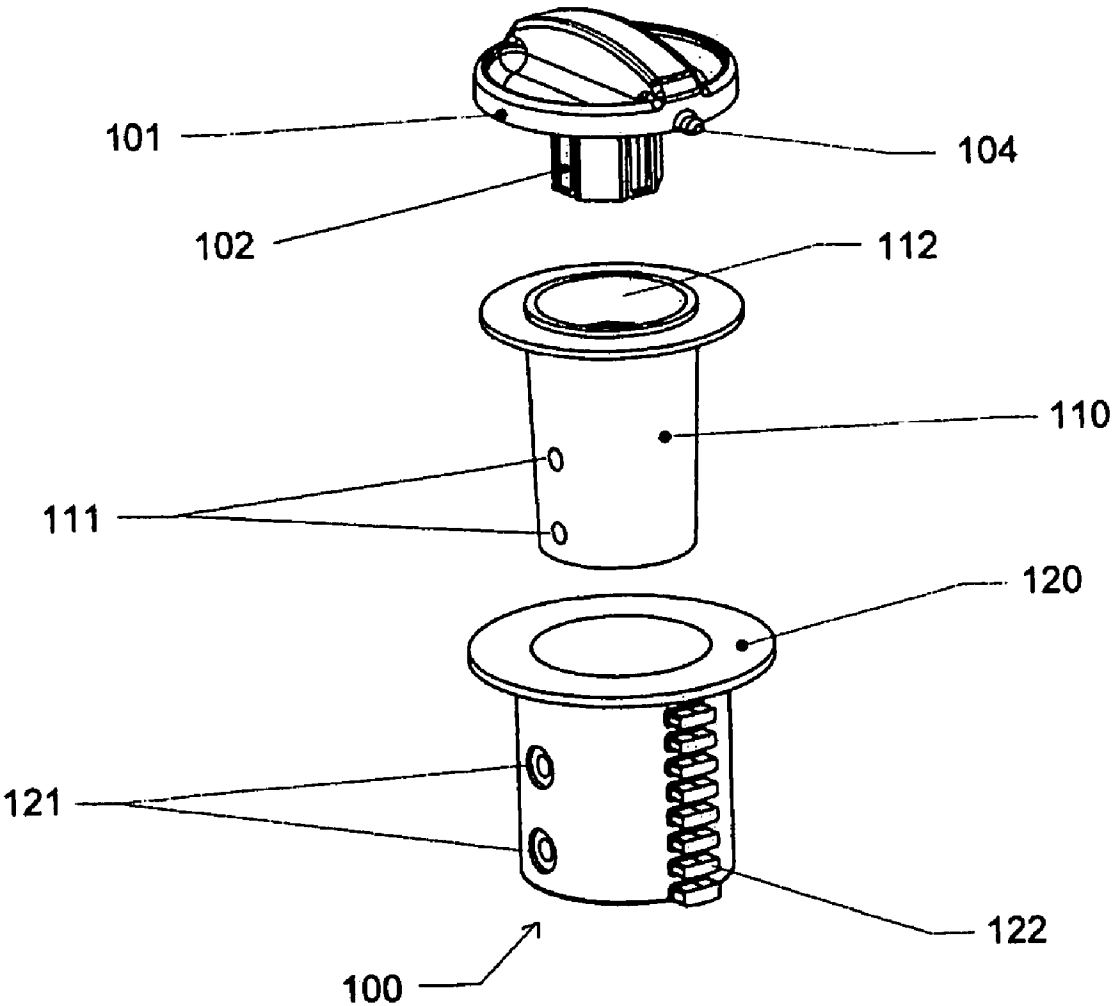
FIG. 4 is a more detailed exploded view of a weight selection assembly in accordance with an exemplary embodiment of the present invention.

FIG. 4 is a more detailed exploded view of the weight selection assembly 100 in accordance with an exemplary embodiment of the present invention. Selector knob 101 engages inner selector tube 110 through a protrusion 102. Protrusion 102 may be sized to provide a slip fit into receptacle 112 of the inner selector tube 110. This slip fit allows an up-and-down sliding movement of the selector knob 101 while transmitting a turning couple to inner selector tube 110. A spring element 104 may be provided between knob 101 and inner selector tube 110, biasing knob 101 upward. Thus, the spring element 104 may provide a detent function, locking knob 101 in position unless the user of the exercise device 1 presses down on knob 101 to change the weight selection. Spring element 104 may be embodied as a plurality of plastic leaf spring elements on the underside of the knob 101. Alternatively, spring element 104 may be composed of foam or elastomer materials having a suitable anti-friction layer on a surface thereof, for example.

Inner selector tube 110 may be inserted into outer selector tube 120 during initial assembly of the exercise device 1.

Fasteners (not shown) may be introduced into holes 111 and 121 to secure the inner selector tube 110 to the outer selector tube 120. The fasteners may be embodied as rivets or screws, although other fasteners may be used, such as snaps between the inner and outer tube, adhesives, ultrasonic welding, and/or posts that provide an interference fit in holes 111 or 121, for example.

The outer selector tube 120 may include a plurality of protrusions or teeth 122 arranged on an outer surface of the outer selector tube 120, as shown in FIG. 4. In general, weight selection may be accomplished by the teeth 122 engaging weight plates arranged in tray 30. This will be described in more detail below.

Figure 5:
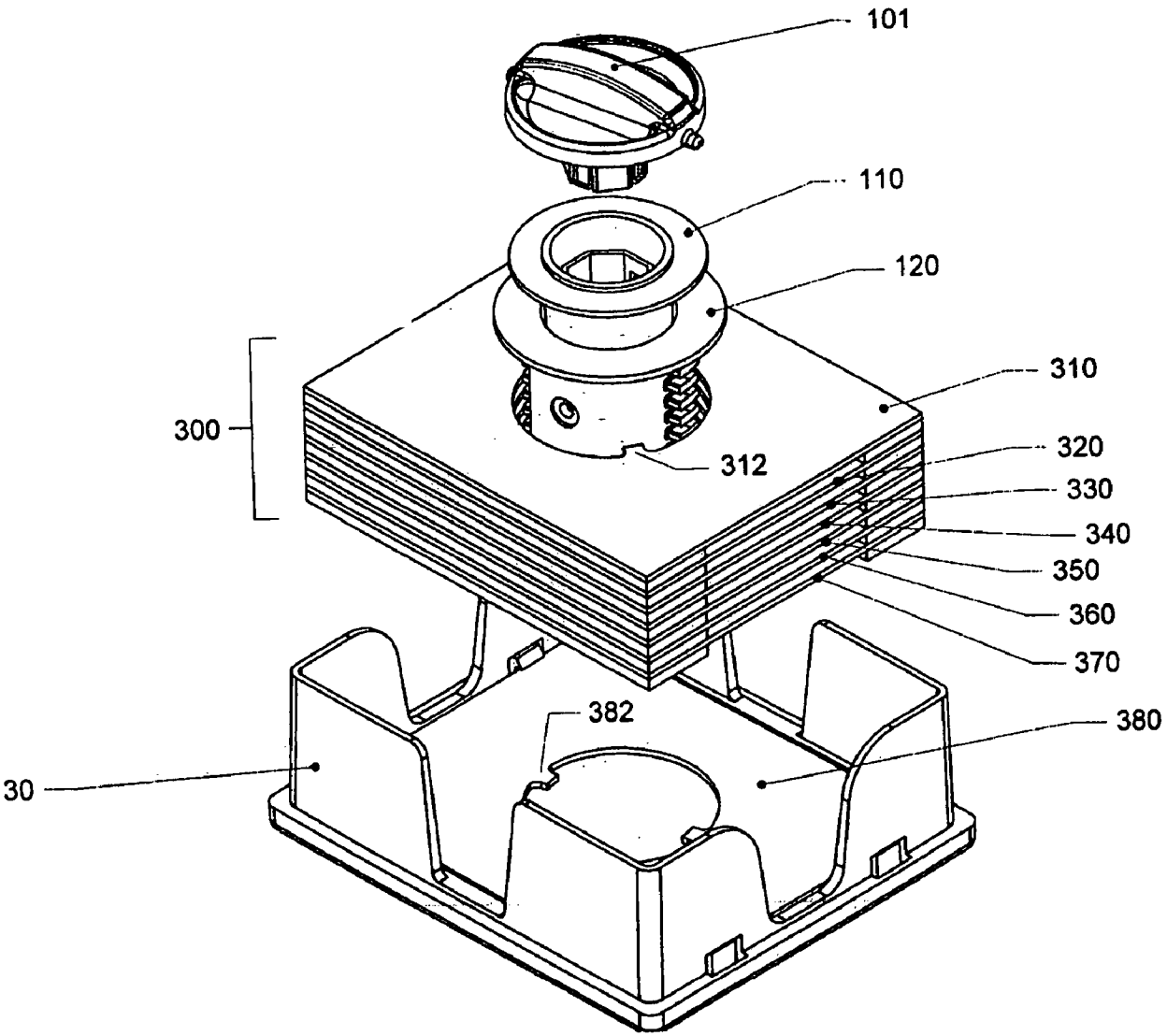
FIG. 5 is a partial exploded view illustrating the selector assembly relative to a stack of weights and the removable tray in accordance with an exemplary embodiment of the present invention.

FIG. 5 is a partial exploded view illustrating the weight selector assembly 100 positioned relative to a stack of weights 300 and the removable tray 30 in accordance with an exemplary embodiment of the present invention. In this exemplary embodiment, tray 30 may be designed to hold up to eight (8) weight plates 310–380, although the exemplary embodiments of the present invention are not limited to tray 30 holding eight weights, device 1 and/or tray 30 may be adapted to hold greater or fewer than eight weight plates. The bottom weight plate 380 may be permanently fixed to tray 30. Alternatively, the bottom portion of tray 30 may be formed so as to have an equivalent weight to the removable weight plates 310–370 that may be added or removed from tray 30. Tray 30 may also be configured to add substantial additional weight to the system for heavy-weight exercises. In other words, tray 30 could be in a substantially larger configuration than shown in FIG. 4 to incorporate a significant mass.

As shown in FIG. 5, weight plates 370, 360, 350, 340, 330, 320 and 310 may be stacked on top of weight plate 380. Each weight plate may include one or more protrusions or teeth (only teeth 312 and 382 are shown for reasons of clarity) and may be selected by changing the rotational position of outer selector tube 120. For example, if teeth 122 are positioned to engage weight tooth 312 of plate 310, weight plate 310 will be selected and held by outer selector tube 120. Similarly, if outer selector tube 120 is rotated so that teeth 122 are in engagement with weight tooth 382, weight plate 380 will be selected and held by outer selector tube 120.

If a given weight plate is selected by the user, all weight plates above the selected weight plate will also be selected. Thus, if weight plate 380 is selected, each of weight plates 310–380 will be held by outer selector tube 120. If weight plate 310 is selected, only that individual weight will be removed from tray 30 and retained by outer selector tube 120, as there are no weight plates above it. This allows the total weight selected to vary from a given minimum to a given maximum weight in tray 30.

As discussed above, weight plate 380 may be permanently attached to tray 30. Thus selection of weight plate 380 corresponds to the maximum weight setting on device 1. Accordingly, tray 30 with all weight plates 310–380 will be retained by outer selector tube 120. This allows use of tray 30 to provide additional weight, and may also provide a clean configuration for storage of exercise device 1.

Figure 6:
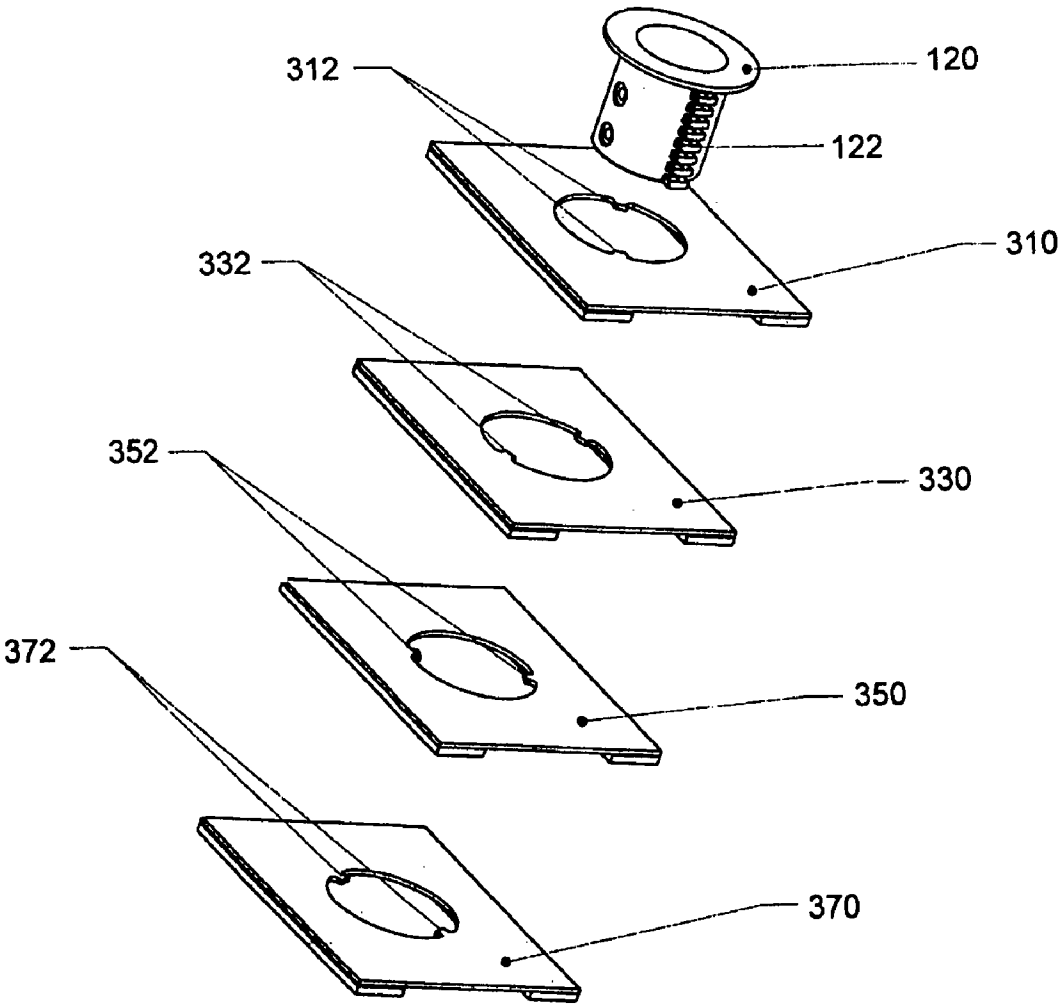
FIG. 6 is an exploded view of the weight plates 300 to illustrate a method of weight selection in more detail, in accordance with an exemplary embodiment of the present invention.

FIG. 6 is an exploded view of the weight plates 300 to illustrate a method of weight selection in more detail, in accordance with an exemplary embodiment of the present invention. Some of the weights in FIG. 6 have been removed for clarity. Outer selector tube 120 is positioned above weight plates 310, 330, 350 and 370. FIG. 6 illustrates how weight teeth 312, 332, 352 and 372 may be arranged, so that teeth 122 on the outer selector tube 120 engage only one of the respective weights. Changing the rotational position of outer selector tube 120 thus changes the engagement sequence, resulting in a different weight selection.

Figure 7:
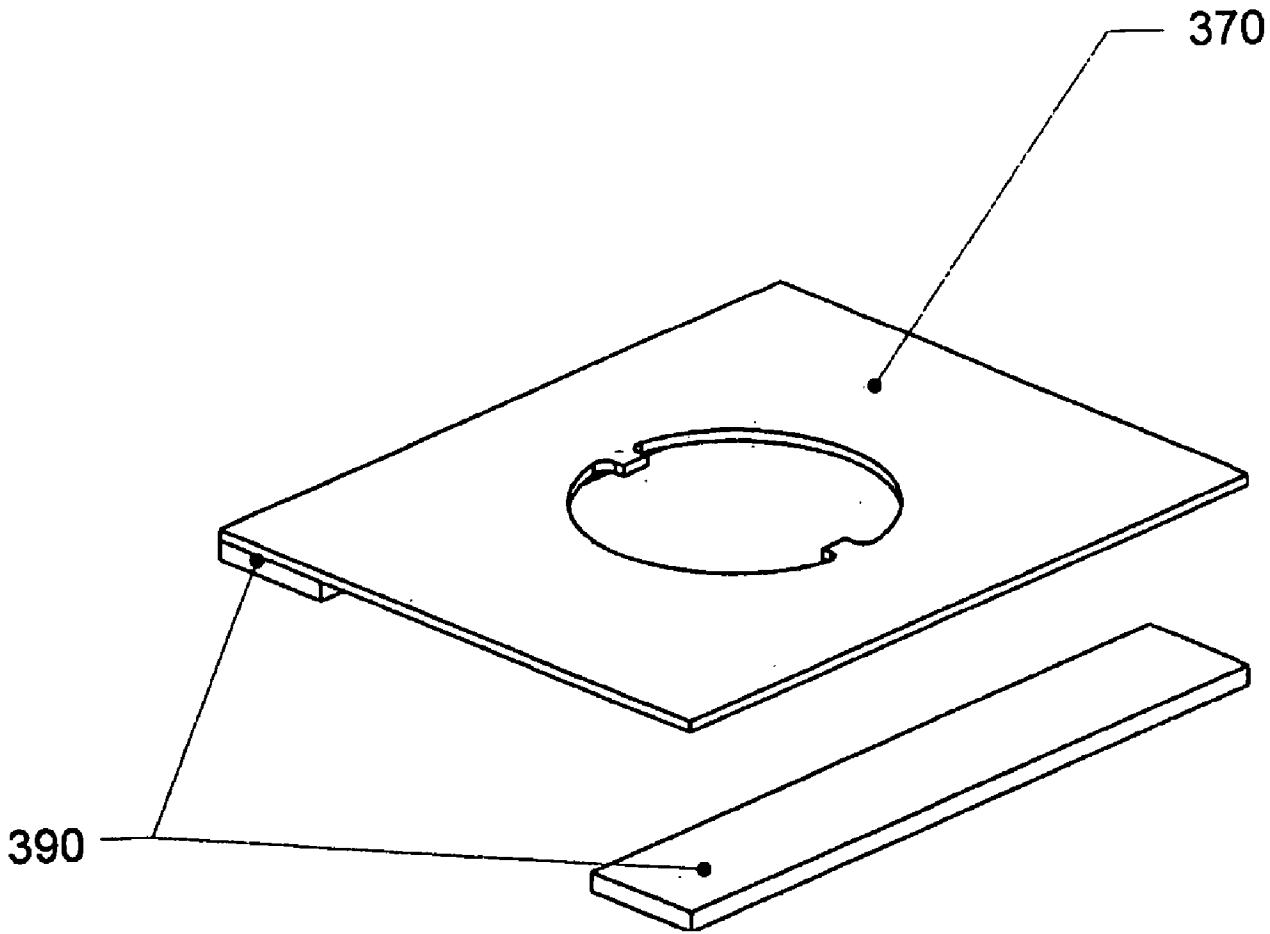
FIG. 7 is a view illustrating an exemplary configuration for a weight plate in accordance with an exemplary embodiment of the present invention.

FIG. 7 is a view illustrating an exemplary configuration for a weight plate in accordance with an exemplary embodiment of the invention. Weight plate 370 is shown as an example, although FIG. 7 is equally applicable to weight plates 310–360. The weight plate 370 may include weight spacer elements 390 attached to the bottom thereof, as shown in FIG. 7. Spacer elements 390 may provide additional weight and may also provide adequate spacing for each weight plate to properly engage teeth 122 of the outer selector tube 120. The spacer elements 390 may be composed of a material similar to the material of weight plate 370, for example, if the spacer elements 390 are designed to add weight. Alternatively spacer elements 390 may be made of lightweight plastic and/or rubber material to provide a spacing function and/or an optional noise dampening function, while adding insignificant weight to weight plate 370.

Unlike weight plates 310–370, weight plate 380 may be permanently attached to tray 30 and does not include spacer elements 390. In this exemplary embodiment, tray 30 weighs approximately the same as the weight of a given spacer element 390. Thus, the weight of weight plate 380—(minus) tray 30 weighs approximately the same as weight plate 370—spacer element 390.

Weight plates 300 shown in FIGS. 6 and 7 are shown in a generally square or plainer configuration. However, it is evident to the ordinary skilled artisan to make and/or form the weights in other shapes, dimensions and orientations (i.e., circular, polygonal, ellipsoidal, etc.). Further, other mechanisms proving the equivalent function of engaging weight selector assembly 100 may be provided on the weight plates 300, in lieu of or in conjunction with the exemplary weight plate teeth shown in FIGS. 6 and 7, for example.

Figure 8:
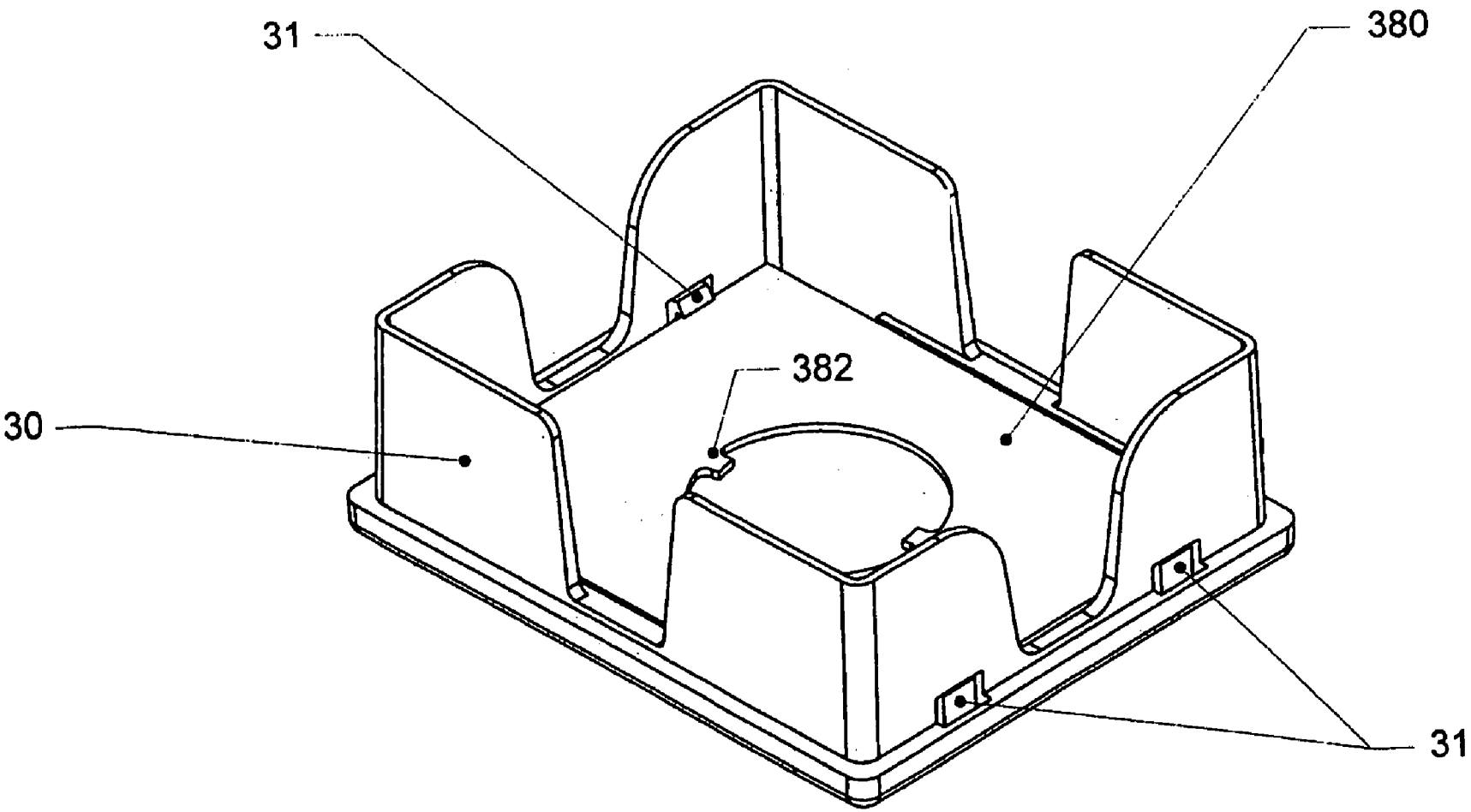
FIG. 8 is a plan view of the removable tray in accordance with an exemplary embodiment of the present invention.

FIG. 8 is a plan view illustrating the tray 30 in accordance with an exemplary embodiment of the present invention. FIG. 8 shows an example of how weight plate 380 may be attached to tray 30, it being understood that weight plate 380 could also form the bottom of tray 30. In this example, weight plate 380 may be attached to tray 30 with a fastener 31. Fastener 31 may be embodied as one or more snap hook elements. The snap hook elements 31 may be plastic and may be integrally molded into tray 30, if the tray 30 is made of plastic.

Figure 9:
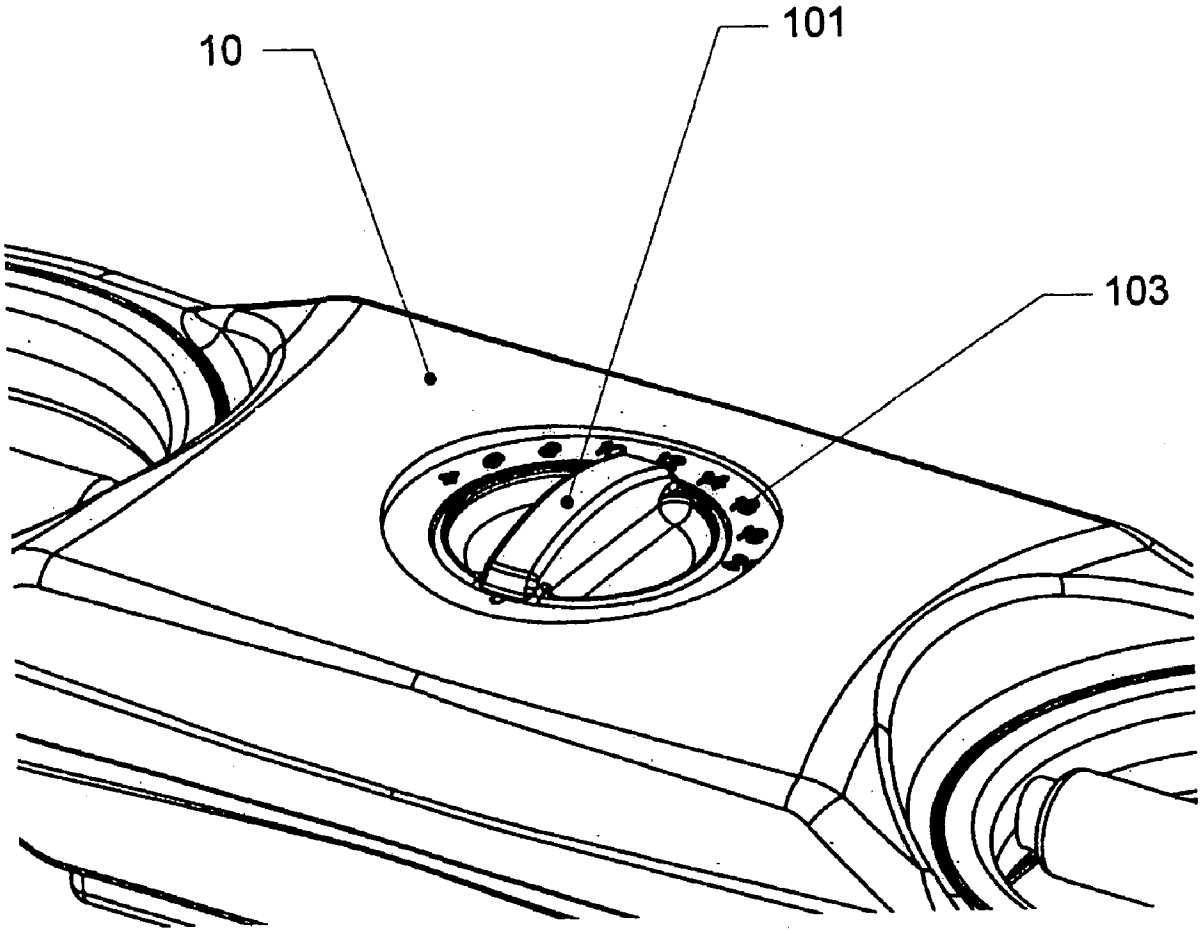
FIG. 9 is a partial enlarged view of the upper housing to illustrate the selector knob in more detail.

FIG. 9 is a partial enlarged view of the upper housing 10 to illustrate the selector knob 101 in more detail. A label 103 may be provided around the rotational periphery of the selector knob 101 on upper housing 10. The label 103 may include indicia to indicate the selected weight. In FIG. 9, the position and orientation of selector knob 101 corresponds with an indicator on label 103, here shown as numbers, although other indicia could be used, such as percentages or a "Euro-style" fuel gauge graphic that wraps around the knob 101, somewhat like a ramp, for example.

The increments and/or indicia on label 103 may depend upon the chosen weight range for a particular embodiment of the present invention. In the example of FIG. 9, the weight ranges from 4 lb. to 20 lb. in nine (9) equal increments. The nine increments correspond to a position for each of the eight weights in this exemplary embodiment, and an additional selector position for no weight selected. The position for no weight selected leaves only the weight of the exercise device 1 without weights 310–380 and tray 30.

The weight of the assembly tray 30 minus the weight 380 weighs the same as any of the other weight plates 310–370 with corresponding spacer elements 390. The weight of the tray 30 replaces the weight of the spacer elements 390, so in this example, the tray 30 weighs 1 lb. Accordingly, in this example, the exercise device 1 weighs approximately 4 lb.

Each additional selected weight plate 310–370 adds 2 lb. Thus, the maximum weight possible in this example is seven 2 lb weights, plus the eighth weight plate 380 and tray 30, which weighs two pounds, for a total of 20 lb. As discussed above, the weight increments, maximum and minimum weights are merely exemplary; the exercise device 1 and tray 30 could be adapted to hold different ranges of weights, depending on the desired size of the exercise device 1 and desired accompanying weight. An exemplary range of weight may be between about at least 2 pounds to at least 100 pounds of weight, although conceivably the exercise device 1 could be adapted to hold even greater amounts of weight.

Figure 10:
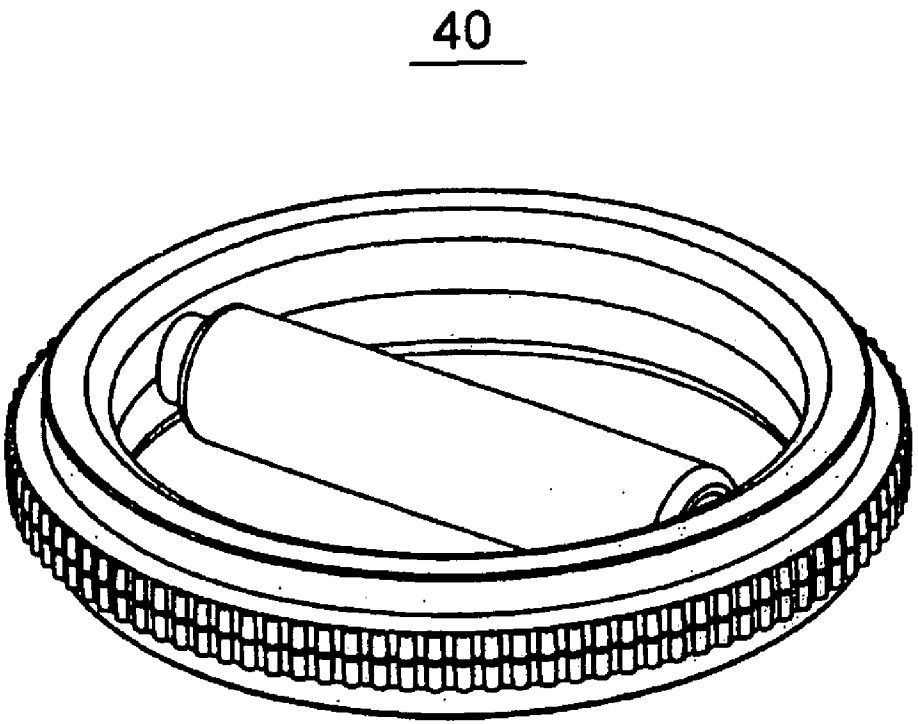
FIG. 10 is a plan view of a rotating handle assembly in accordance with an exemplary embodiment of the present invention.
Figure 11:
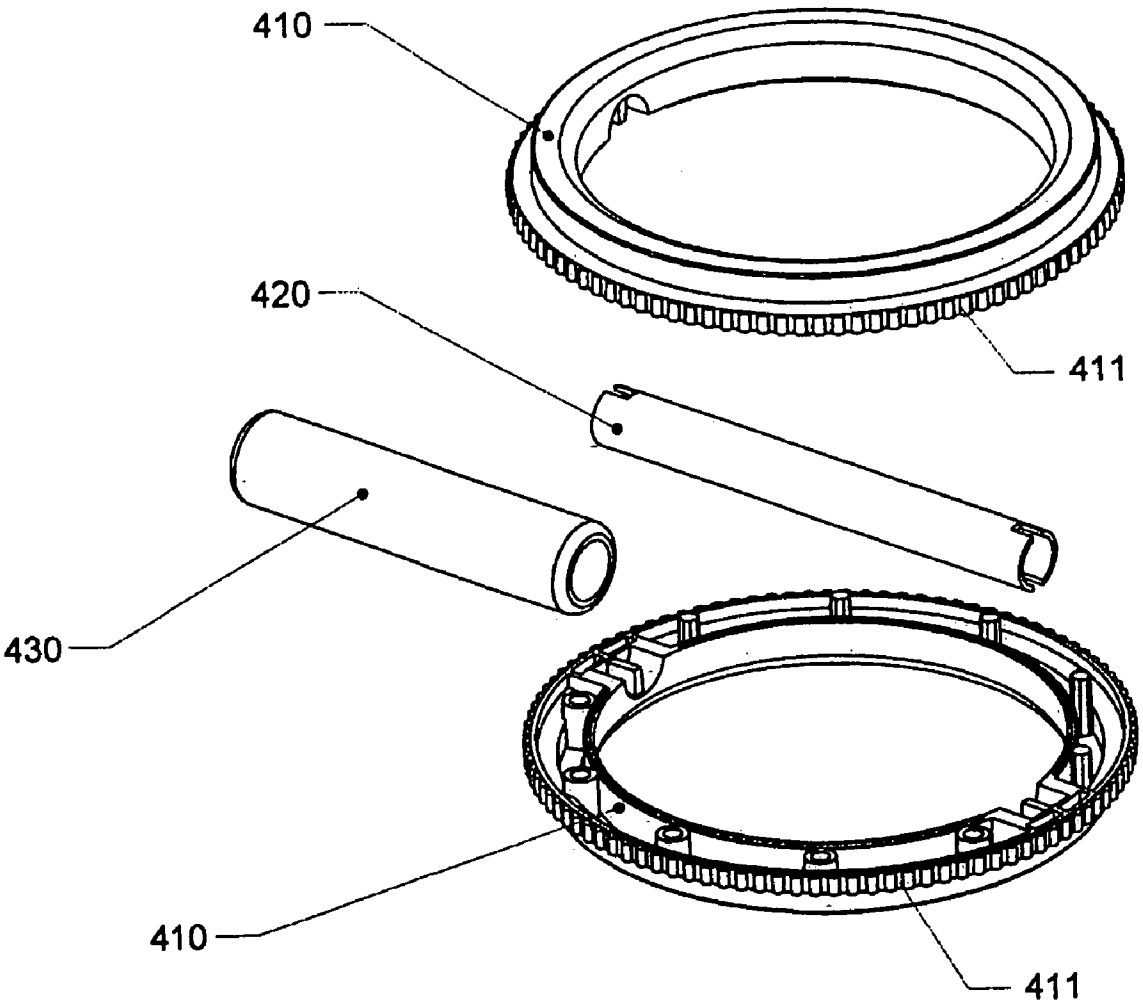
FIG. 11 is an exploded view of FIG. 10 to illustrate the construction of the rotating handle assembly.

FIG. 10 is a plan view of a rotating handle assembly 40, and FIG. 11 is an exploded view to illustrate the construction of the rotating handle assembly 40. Referring to FIGS. 10 and 11, the handle assembly 40 may include ring halves 410, a rigid tube 420 and a handle 430. Handle 430 may be a soft handle or a malleable material such as foam, flexible rubber or soft plastic, for example and may be provided over rigid tube 420 as shown in FIG. 10, for example. The tube 420 and handle 430 collectively form a subassembly 420–430. Subassembly 420–430 may be placed between ring halves 410, for example.

The handle assembly 40 may be mounted between upper housing 10 and lower housing 20 in a manner that allows handle assembly 40 to rotate independently. Thus, it may be possible for a user of the exercise device 1 to change hand orientation while exercising with the exercise device 1. This may provide unique advantages for training desired muscle groups by performing particular exercises.

Figure 12:
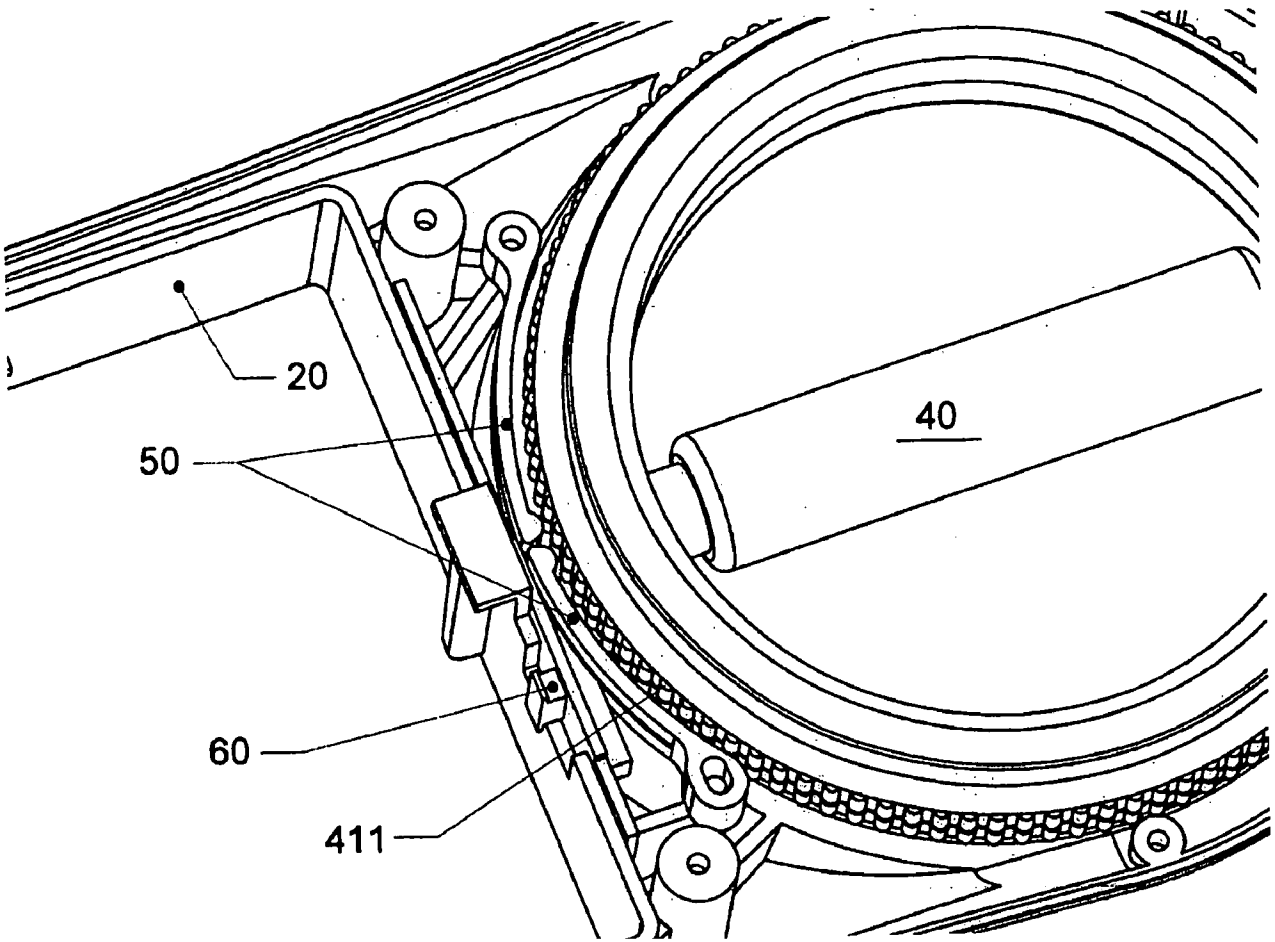
FIG. 12 is a partial enlarged top view of the handle assembly and lower housing.
Figure 13:
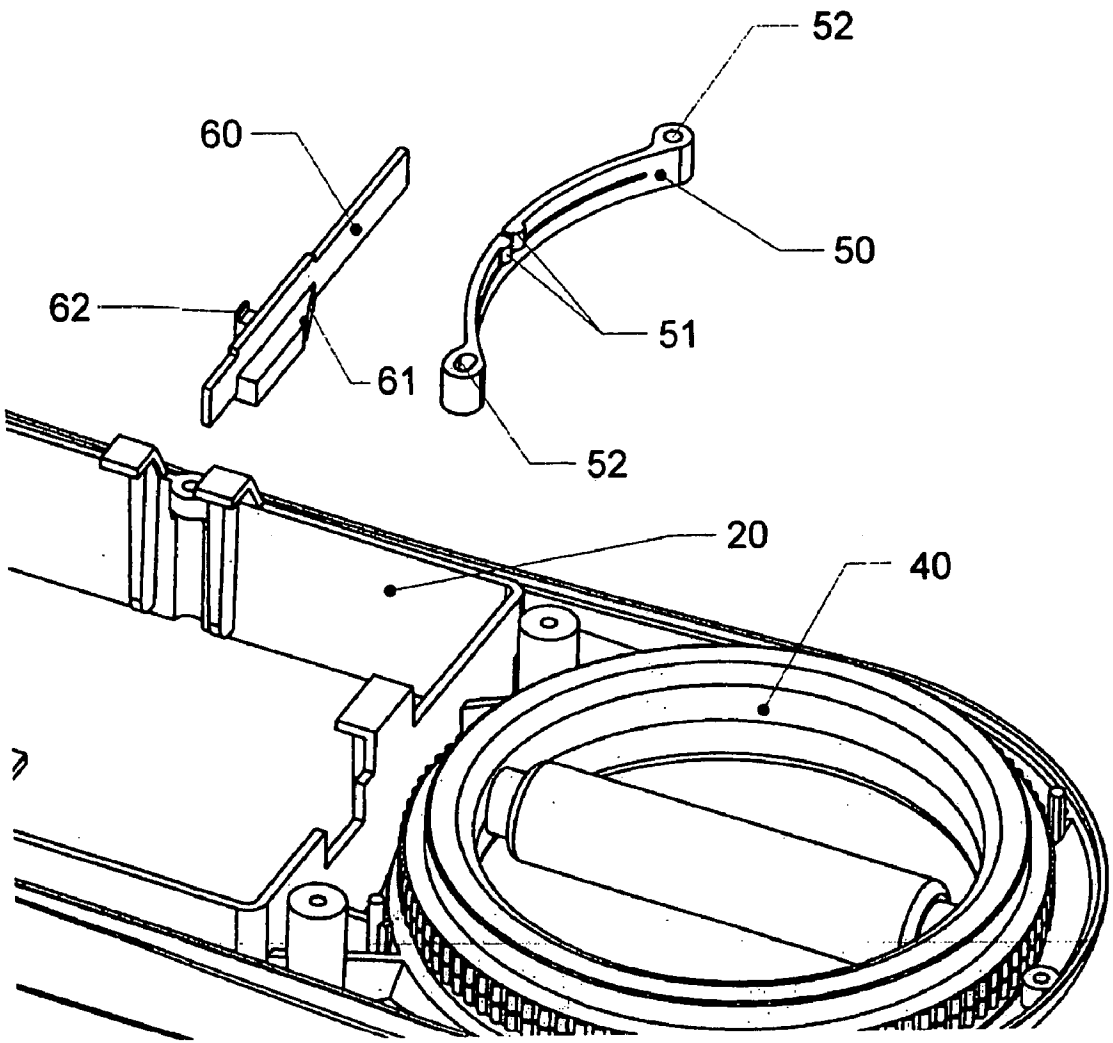
FIG. 13 is a partial exploded view illustrating a resistance/sound element in accordance with an exemplary embodiment of the present invention.

FIG. 12 is a partial enlarged top view of the handle assembly 40 and lower housing 20, and FIG. 13 is a partial exploded view illustrating a resistance/sound element in accordance with an exemplary embodiment of the present invention. The exercise device 1 may also include an element or device to create sound and resistance while the user actuates handle assemblies 40. Sound and resistance mat be generated by interaction between a resistance/sound element 50 and a selector switch 60.

Referring to FIG. 12, the resistance/sound element 50 may be mounted in lower housing 20 in proximate relationship to teeth 411 of rotating handle assembly 40. To vary the position of the selector switch 60, the user may reach up inside the cavity 25 of lower housing 20 when no weight is selected. Alternatively, selector switch 60 may be provided on an outer surface of the upper housing 10 or lower housing 20 in the vicinity of the rotating handle assemblies 40. Thus, the user may vary the sound and resistance created while actuating handle assembly 40.

In this example, the selector switch 60 may have a range of motion between two extreme positions. A first extreme position of selector switch 60 may result in maximum sound and resistance, while at a second extreme position, resistance/sound element 50 is not contacting teeth 411, so there is minimum sound and resistance. Of course, the selector switch 60 may be set at intermediate position, between the first and second extreme positions.

Referring to FIG. 13, resistance/sound element 50 may be flexible and may include teeth 51 positioned to contact teeth 411 of rotating handle assembly 40. Resistance sound element 50 may include mounting lugs 52 which may engage corresponding mounting bosses (not shown for reasons of clarity) on lower housing 20 and upper housing 10 to mount sound resistance element 50 to lower housing 20. Selector switch 60 may further include a ramp 61 and a tab 62. When the selector switch 60 is moved to a given position, ramp 61 comes in contact with resistance/sound element 50, biasing the teeth 51 towards teeth 411 of handle assembly 40. The resultant contact creates sound and resistance while handle assembly 40 is actuated by the user. The user may change the position of selector switch 60 by moving tab 62 on the switch body.

A selector switch 60 and sound resistance element 50 may be provided for each of the two rotating handle assemblies 40 of the exercise device 1. Thus, it may be possible to independently select sound and resistance for one or both of the handle assemblies 40.

Accordingly, handle assemblies 40 may be configured to provide directional movement other than rotational (lateral, transverse, etc.) within openings 15, for example. Further, one of ordinary skill in the art may modify rotating handle assemblies 40 to include other structural elements in lieu of teeth to engage resistance/sound element 50, for example. As described above, resistance/sound element 50 and selector switch 60 illustrate one exemplary embodiment, other configurations for providing sound and resistance are evident within the ordinary skill of the art.

Manufacturing Methods

Figure 14:
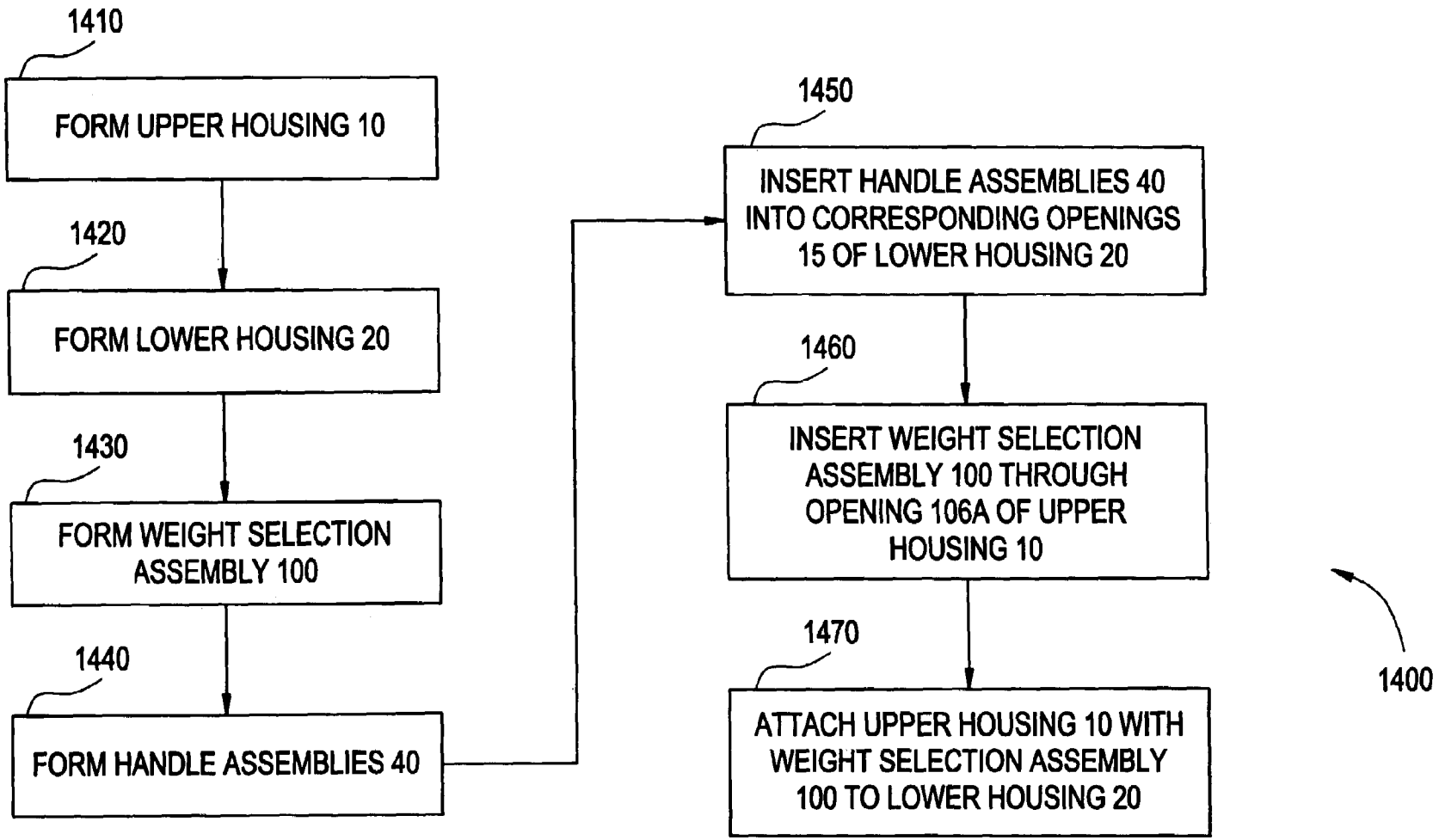
FIG. 14 is a flow diagram illustrating a method of manufacturing the exercise device in accordance with an exemplary embodiment of the present invention.

FIG. 14 is a flow diagram illustrating a method of manufacturing the exercise device in accordance with an exemplary embodiment of the present invention. Referring to FIG. 14, there is shown an exemplary manufacturing process for fabricating the exercise device 1. It should be understood that the following functions may be performed in a variety of different functional orders to fabricate the complete exercise device 1.

In the method, the upper housing 10 may be formed (1410) and the lower housing 20 may be formed (1420) by a suitable fabrication process, described in further detail below. Each of the upper housing 10 and lower housing 20 may be composed of a frame provided with a central opening and a pair of outer openings, one opening at either side of the central opening. The central opening may be openings 106*a* and 106*b* of FIG. 3, and the outer openings may be openings 15 shown in FIG. 1, for example. Further, the lower housing 20 may be formed so as to have a centrally located cavity, which may be cavity 25 of FIG. 1, for example.

Weight selection assembly 100 may then be formed (1430) by a suitable fabrication process described in further detail below, although this may be formed independent from the upper and lower housing 10 and 20. To form the weight selection assembly 100, the inner selector tube 110 and selector knob 101 may be formed, and the selector knob 101 inserted into the inner selector tube 110 to form the subassembly 101–110. The outer selector tube 120 may be formed, with the subassembly 101–110 inserted into outer selector tube to provide a contiguous weight selection assembly 100. Friction washer 113 and support plate may be provided between the subassembly 101–110 and outer selection tube 120 (see FIG. 3) for support.

The rotating handle assemblies 40 may be formed (1440) by a suitable fabrication process described in further detail below, although rotating handle assemblies 40 may also be formed independent from the forming of the upper and lower housing 10 and 20 and weight selection assembly 100. Each handle assembly 40 may be inserted (1450) into a corresponding opening 15 of the lower housing 20 (as shown in FIG. 3) so as to be supported by the lower housing 20 frame.

The weight selection assembly 100 may be inserted (1460) through the central opening 106*a* in the upper housing 10, and the upper housing 10 with weight selection assembly 100 may be attached (function 1470) to the lower housing 20 so that a portion of the weight selection assembly (e.g., outer selector assembly 120 with teeth 122) extends into the cavity 25 of the lower housing 20. Suitable fasteners may be provided to fixedly secure the upper and lower housings 10 and 20 together, such as rivets, screws, adhesives, etc. Accordingly, fabrication of the exercise device 1 is completed.

Separately, tray 30 may be formed by a suitable fabrication process, described in further detail below. Tray 30 may be formed in a configuration for holding weight plates 310–380 and the dimension adapted so as to comfortably fit within the cavity 25 of the lower housing 20 for engagement of one or more weight plates 310–380 therein by weight selection assembly 100.

In general, individual components of the exercise device 1 described herein may be fabricated primarily from lightweight materials such as moldable plastic. Upper housing 10 and lower housing 20 may be formed by an injection molding process from a high impact plastic, such as Acrylonitrile Butadiene Styrene (ABS). ABS is an easily machined, tough, low cost rigid thermoplastic material with high impact strength, and may be a desirable material for turning, drilling, milling, sawing, die-cutting, shearing, etc. However, ABS is merely one exemplary material; equivalent materials may include various thermoplastic and thermoset materials that have characteristics similar to ABS. For example, talc-filled polypropylene, high strength polycarbonates such as GE Lexan®, or blended plastics may be used instead of or in addition to ABS.

An exemplary injection molding system for forming molded plastic articles may be the Roboshot® injection molding machine from Milacron-Fanuc. The Roboshot® is one of many known injection molding machines for forming plastic injection molds. Other plastic molding processes such as vacuum forming may be used, but these alternative processes may not provide the structural advantages and cost advantages of injection molding. Alternatively, the upper housing 10 and lower housing 20 may be formed using a metal casting process such as sand casting, die casting, or investment casting, for example.

The weight selection assembly 100 may also be molded of plastic. Selector knob 101 and inner selector tube 110 may be formed by an injection molding process from a high impact plastic such as ABS. Selector knob 101 and inner selector tube 110 may be formed from virtually any plastic or metal material, since they are not critically loaded. The decision of material may be based on factors such as cost and/or appearance considerations.

Outer selector tube 120 may require a more durable material as it requires additional strength. Due to the loads on teeth 122, outer selector tube 120 may be molded of a more durable material than ABS, such as glass-filled nylon. However, the composition of outer selector tube 120 is not limited to glass-filled nylon, any material having similar fracture toughness characteristics to glass-filled nylon may be suitable equivalents Such materials may be characterized as being able to absorb energy without cracking, or materials which do not shatter under substantially sharp impact loads, for example. Metal castings may be used to form outer selector tube 120, as well as machined metal construction. Other high performance molded and composite materials may also be adequate for outer selector tube 120, but may not offer cost advantages as compared to glass-filled nylon, for example.

Support plate 115 may be fabricated from high performance molded or sheet plastic, a suitable light, yet strong metal such as a high-strength, low alloy steel, aluminum, etc., and/or a composite synthetic material such as a carbon fiber/epoxy material, for example. Alternatively, support plate 115 may be incorporated into molded upper housing 10. Friction washer 113 may also be formed from a wide variety of metals and plastics. The function of friction washer 113 is to provide desirable wear surface characteristics at a relatively low cost.

Removable weight tray 30 may be formed from injection molded ABS. However, tray 30 may be molded or machined from a number of different plastic or composite materials, or may be cast from a number of different metals. Cost and weight may play a consideration in choosing the desired process and material for forming tray 30.

The weight plates 300 may be stamped from hot-rolled steel, for example. Alternatively, weight plates 300 may be cut from cold-rolled steel, stamped from a stainless steel alloy, formed of cast metals or machined metals, etc. Further, the weight plates may be formed by a process using heavy filler materials such as concrete or soft lead in a molded or formed outer housing. It is also within the skill of the art to employ other known methods of assembling stamped metal pieces to create the weight plates. A basic requirement is that the weight plates 300 be formed of a strong enough material that the teeth 312–382 are sufficiently durable and at a reasonably accurate enough location on the associated weight plate to successfully engage teeth 122 of the outer selector tube 120.

As discussed above, the spacer elements 390 may be composed of a suitable incompressible metal material used to form the weight plates 300, such as hot-rolled steel, titanium, aluminum, etc. However, spacer elements 390 could be formed of a plastic and/or hard rubber compound. The rubber may provide acceptable noise damping characteristics if only a spacing function is desired for spacer elements 390. Metal may be desirable because it adds weight. The spacer elements 390 may be spot-welded or punched and welded to each of the weight plates 310–370. Rivets, screws, adhesives and other known fasteners within the skill of the art may be used in place of spot welding.

The rotating handle assemblies 40 may be composed of a rigid aluminum tube 420 encased by a soft handle 430 that may be embodied as a foam rubber grip 430, for example. Grip 430 may either be extruded or molded into a desired shape. The ring halves 410 may be formed by an injection molding process of ABS plastic, for example, although a number of alternative methods may be employed to form handle assemblies 40.

For example, the entire handle assembly 40 could be cast or molded as a single piece of plastic or metal. Alternatively, tube 420 can be formed of any desired material that has sufficient strength to perform under the anticipated loads. Further, the handle assemblies 40 may change based upon the empty weight requirements of cavity 25. In this example, the empty weight of overall exercise device 1 should be approximately 4 lb. Handle assemblies 40 provide a convenient location to tailor the final empty weight of the exercise device 1 without tray 30 and associated weigh plates 300.

Depending on the design, the empty exercise device 1 may be lightened or weighted based on the materials chosen for the components of the handle assemblies. For example, tube 420 may be a thin-walled aluminum for tube 420. If, by a different choice of material for upper housing 10 and lower housing 20, for example, weight needed to be added to reach 4 lbs empty, tubes 420 could be composed of hollow or solid steel. Filling tube 420 with lead or concrete might significantly alter the weight of the handle assembly 40. Likewise, casting the entire handle assembly 40 from a metal or metal-filled plastic may also increase the weight.

The construction of soft handle 430 may vary based upon factors such as comfort and durability requirements. The shape of soft handle 430 can be molded for maximum comfort or extruded to lower cost, as an example. Similarly, tube 420 could be formed in a contoured shape, eliminating the need for soft handle 430. If the entire handle assembly 40 was molded or formed as an integral part and the central handle region was contoured, the soft handle 430 could be eliminated.

There may be a number of ways to provide sound and resistance for rotating handle assemblies 40. This sound and resistance may be selectable. The sound and resistance element 50 and selector switch 60 in the exemplary embodiment represent a simple contact friction system. However, in addition to friction of flexible elements or springs, the resistance may be generated by fluid viscosity, magnetic induction, or electromagnetism, for example. Sound may be generated by contact friction, air movement, vibration of taut string elements, or may be generated via an electrical/electronic source or device. If additional resistance is required, elastomer friction blocks (not shown) may be added to the existing design.

Method and System for Interacting with an Exercise Device

Figure 15:
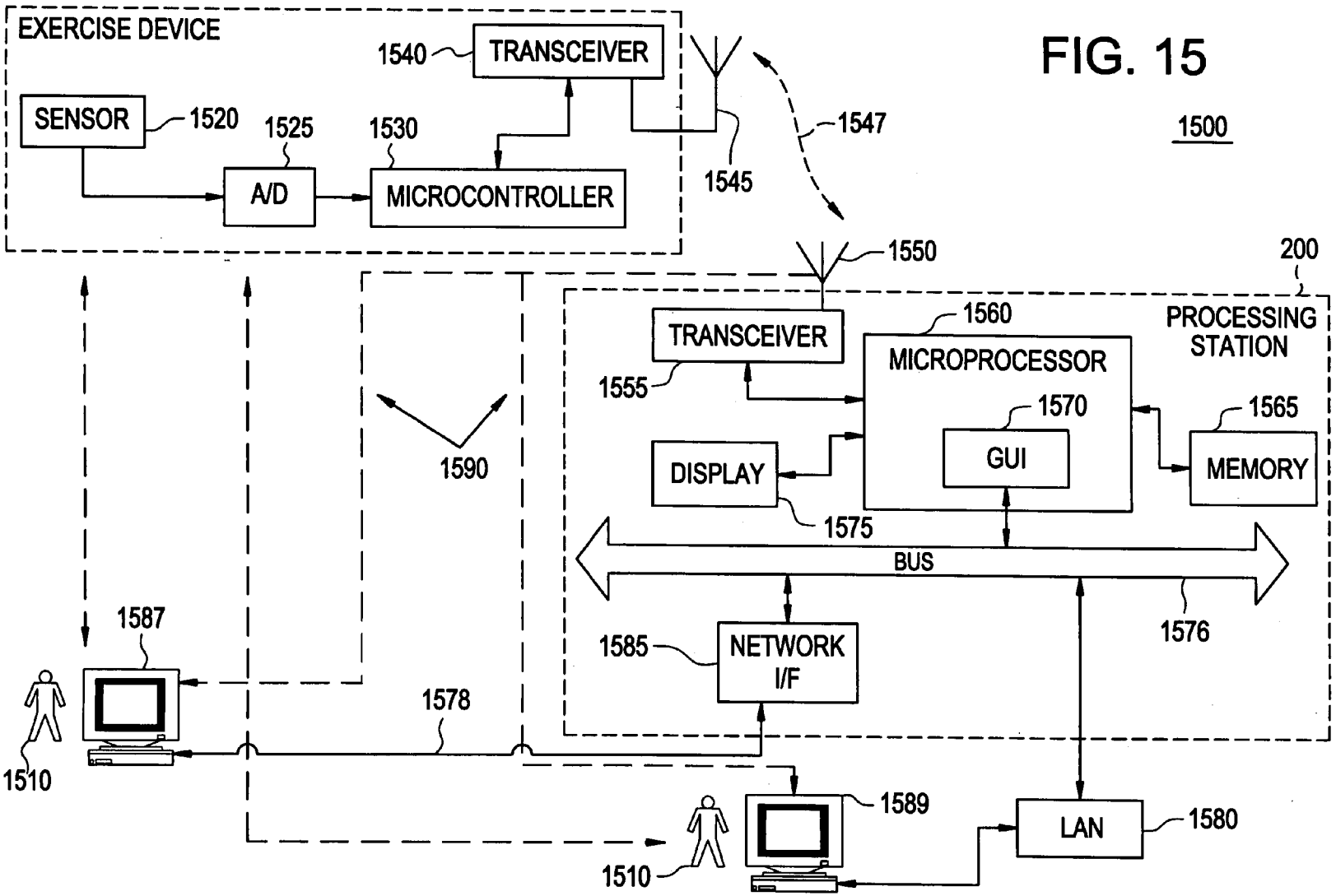
FIG. 15 is a block diagram illustrating a method and system for interaction with an exercise device in accordance with an exemplary embodiment of the invention.

FIG. 15 is a block diagram illustrating a method and system for interaction with an exercise device in accordance with an exemplary embodiment of the invention. In particular, there is described a method and system 1500 for tracking a physical workout by a user manipulating an exercise device.

Although motion tracking systems for weight machines with mechanically constrained movements have been developed, due to the inherent difficulties of tracking devices with free ranges of motion, no known capability is believed to exist for free weight exercise devices. Accordingly, the following method may be adapted for an exercise device such as described above. However, the following method may be implemented in exercise devices other than the exercise device 1 described above, such as conventional free weights, individual weight stations such as weight machines of a NAUTILUS® system, exercise bikes, treadmills, step machines such as STAIRMASTER® machines, etc.

Referring to FIG. 15, in the method, one or more devices at the exercise device may detect one or more parameters related to spatial movement of the exercise device by a user (shown generally as user 1510, as indicated by the dotted lines extending from the user 1510 to the exercise device). In an aspect, the detecting function may be performed by one or more suitable sensors 1520 physically located on the exercise device. In an alternative aspect, the detecting function may be performed by one or more suitable sensors 1520 located externally (not shown) from the exercise device. The parameters may be embodied as one or more of a rate of lift parameter of the exercise device during movement by the user, a range of motion parameter of the exercise device during movement by the user, a number of repetitions parameter of the exercise device by the user for a specified workout routine, and/or a jitter parameter related to pitch and yaw (e.g., translational movement) of the exercise during movement by the user. In another example, the sensors 1520 may track the revolutions and time a user performs an exercise which involves the user rotating the exercise device with his/her hands in a manner that mimics peddling a bicycle using his/her hands. The user may thus focus on the revolution/time count as a measure of their work completed in a given workout session.

The sensors 1520 may be embodied as at least one of an accelerometer, a gyroscope, a pressure sensor, a proximity sensor, an infrared sensor and an optical sensor, or combinations thereof that detect one or more of the parameters and output a signal (such as an analog signal) that may be converted (i.e., by a suitable A/D converter 1525) into digital data. The digital data may be processed in an intelligent electronic device 1530 provided on the exercise device.

For example, in an embodiment in which the detected parameter data is communicated as an analog signal by the sensor(s) 1520, the signal may be converted to digital data by A/D converter 1525 and processed in a microcontroller 1530 (intelligent electronic device) operatively connected to an output of the A/D converter 1525. The microcontroller 1530 may process the digital data into a suitable form, such as an RF signal containing a data packet, that is transmitted from an antenna 1545 of a transceiver 1540 that is operatively connected to the microcontroller 1530, similar to how packetized voice or data traffic is wirelessly transmitted over an air interface from a cellular phone to a base station transceiver servicing the cellular phone, for example.

For example, if the sensor 1520, via the intelligent microelectronic device 1530, is operatively connected to a miniature RF transceiver 1540 on the exercise device, the detected parameter data may be packetized in the transceiver 1540 and transmitted as part of one or more packets of data wirelessly over a air link 1547 to an antenna 1550 of a remote receiver. The remote receiver may serve as a second transceiver 1555 at a remote location, such as a transceiver that is operatively connected to downstream processing circuitry of a processing station (as shown in FIG. 15). The processing station (which may be located within a gymnasium or workout club) receives the detected parameter data over the link 1547 via antenna 1550 of transceiver 1555 and forwards the detected parameter data to downstream processing circuitry.

The various sensors, microelectronics and transceiver circuitry may be powered from a suitable power source such as rechargeable secondary battery. Rechargeable secondary batteries for powering portable electronic devices are well known, evidenced by the battery packs used to power low-voltage electronic devices such as cellular phones, personal digital assistants (PDA's) and laptop computers. Accordingly, suitable battery pack candidates may be battery packs consisting of one or more cells having a nickel-metal-hydride (NiMH), nickel cadmium (NiCd) or lithium ion (Li+) cell chemistry with associated electrolyte.

The processing station may be embodied in hardware and/or software as a digital microprocessor 1560 within a suitable personal computer that includes a wireless hub and associated transceiver components and circuitry. However, instead of a digital microprocessor, an analog processor, digital signal processor and/or one or more application specific integrated circuits controlled by a suitable microcontroller or microprocessor may be provided in the processing station, for example. Power may be provided by a suitable AC power source or embedded battery pack as described above.

Users 1510 may communicate with microprocessor 1560 over a suitable encrypted medium such as an encrypted 128-bit secure socket layer (SSL) connection 1578, although the present invention is not limited to this encrypted communication medium. If the processing station is embodied as a server, user 1510 may connect to the server over the internet or from any one of a personal computer, laptop, PDA, etc., using a suitable network interface 1585 such as a web-based internet browser. Further, processing station may be accessible to internal users 1510 via a suitable local area network connection 1580, so that internal users 1510 have access over an intranet for example. Graphical information may be communicated over the 128-bit SSL connection 1578 or LAN 1580, to be displayed on a suitable display device 1587 or 1589 of the user 1510.

The processing station may include a data bus 1576. Bus 1576 may be implemented with conventional bus architectures such as a peripheral component interconnect (PCI) bus that is standard in many computer architectures. Alternative bus architectures such as VMEBUS, NUBUS, address data bus, RAMbus, DDR (double data rate) bus, etc. may be utilized to implement bus 1576.

Microprocessor 1560 represents a central nexus from which all real time and non-real functions in the processing station are performed, such as graphical-user interface (GUI) and browser functions, directing security functions, directing calculations for display and review by the user. Accordingly, microprocessor 1650 may include a GUI 1570 which may be embodied in software as a browser. Browsers are software devices which present an interface to, and interact with, users 1510 of the system 1500. The browser is responsible for formatting and displaying user-interface components (e.g., hypertext, window, etc.) and pictures.

Browsers are typically controlled and commanded by the standard hypertext, mark-up language (HTML). Additionally, or in the alternative, any decisions in control flow of the GUI 1570 that require more detailed user interaction may be implemented using JavaScript. Both of these languages may be customized or adapted for the specific details of a given application server 200 implementation, and images may be displayed in the browser using well known JPG, GIF, TIFF and other standardized compression schemes, other non-standardized languages and compression schemes may be used for the GUI 230, such as XML, "home-brew" languages or other known non-standardized languages and schemes.

Microprocessor 1560 may invoke cryptographic hardware or software to establish a firewall to protect the processing station from outside security breaches. The cryptographic hardware or software secures all personal information of registered users 1510.

The digital microprocessor 1560 of the processing station may evaluate the received parameter data. The evaluation may include determining a fitness score that takes into account at least one of the age, gender and health/fitness condition of the user 1510. Additional input to the fitness score may include the aforementioned parameters related to spatial movement of the exercise device by the user 1510.

The processing station may include memory 1565 (such as various types of RAM, ROM, optical storage, magnetic disk storage, etc.) for storing or recording the performance data. The processing station may receive inputs from an input device (keypad, mouse, touch screen, voice command, etc.) at the user 1510, via interfaces 1580, 1585, bus 1576 and GUI 1570 for enabling display of the performance data via GUI 1570 to the user 1510.

In an aspect, the GUI 1570 may be adapted to enable, via an animated display 1575 at the processing station, a graphic display of a proper form of a selected exercise to help instruct the user 1510. For example, the GUI 1570 may be adapted to graphically mimic, on display 1575 (or displays 1587 and 1589), a particular exercise being performed by the user 1510 in at least one of a real time mode and a playback mode, so as to indicate whether the exercise is performed properly, and/or to display a fitness score for the individual exercise. Further, GUI 1570 may enable the user 1510 to locally or remotely download a given workout plan, or a review of the user's workout history, via at least one of an intranet and the Internet, as discussed above.

Based on the evaluation, the processing station may output performance data related to the workout. In an aspect, the performance data may be related to at least one of a quality measure and quantity measure of the workout. For example, the processing station may output, on display 1575, a single fitness score for the user related to quality of the workout that is based on the evaluation. Alternative, after a series of workouts, a single fitness score may be generated to evaluate the overall workout session.

The fitness score may be displayed locally on a display 1575 at the processing station. Alternatively, the fitness score or other data may be processed in microprocessor 1560 into a suitable form for transmission from the antenna 1550 of transceiver 1155 over an airlink 1590 to a remote location at the user 1510. For example, if the user has an electronic device configured with appropriate transceiver circuitry (wireless PDA, cell phone, wireless PC, etc), the transmitted data may be converted into a suitable digital video image for display at display units 1587, 1589.

In another aspect, the performance data may be displayed in substantially real time (except for minor transmission losses over the air link due to interference or path signal loss) for a specified workout routine. The displayed performance data may include, but is not limited to, graphical data representing a rate of lift of the exercise device during movement by the user, a range of motion of the exercise device during movement by the user, time the user used the device, and/or a number of repetitions of the exercise device by the user.

In a further exemplary embodiment, a gaming device with interface (not shown) may be provided for translating physical movements by a user manipulating an exercise device to gaming software of the gaming device displaying an active game. For example, sensory devices 1520 on an exercise device in communication with a suitable software program or algorithm and transceiver circuitry may be adapted to convert spatial movements of the exercise device by the user to mimic or correspond to movements within a displayed game operatively controlled by the gaming device.

Accordingly, the method and system of tracking a physical workout by a user manipulating an exercise device such as a free weight device may offer several benefits. Instantaneous feedback of exercise metrics for range of motion, rate of lift and/or number of repetitions may allow a user to adjust their form to obtain maximum muscle workout and reduce potential incidence of injury. Remote hands-free recording of exercise performance provides the user, trainer, or therapist the capability to evaluate the quality of a workout at the end of a session and progress over time. Near-instant feedback and the interactive gaming capabilities may provide an element of mental stimulation to an otherwise boring and tedious experience.

Further, a single fitness score may be output for the user for comparison to other people, thus allowing for friendly competition or just general comparison. This may add a new element to fitness training that can make training more rewarding and enjoyable. Users may also receive a single fitness score representing a consolidation of their entire workout, making it easy to remember and record. Providing a single fitness score may also facilitate the user tracking their own progress.

Accordingly with regard to FIG. 15, parameters other than or in addition to rate of lift, range of motion and number of repetitions by the user of an exercise device may be tracked and displayed on a suitable display device. Moreover, the exemplary fitness score may take into account other parameters and characteristics other than, or in addition to one or more of age, gender and/or health/fitness of the user 1510. Further, it is within the skill of the art to configure alternative sensory devices or equivalent structure that provide a like output signal based on a detected parameter, other than or in addition to the aforementioned accelerometers, gyroscopes, pressure sensors, proximity sensors, infrared sensors and/or optical sensors.

Figure 16:
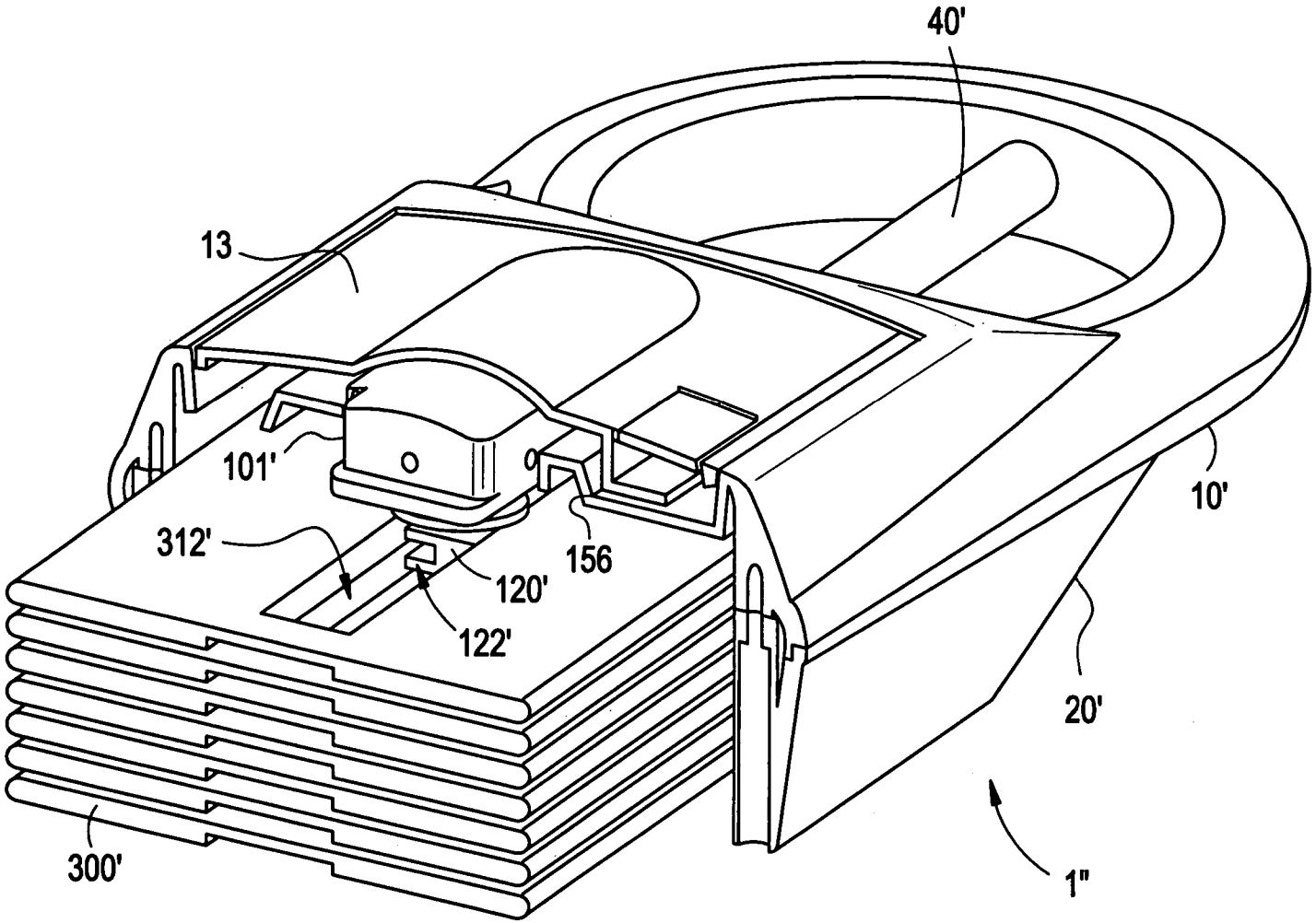
FIG. 16 is a partial cut-away view of an exercise device in accordance with another exemplary embodiment of the present invention.

FIG. 16 is a partial cut-away view of an exercise device in accordance with another exemplary embodiment of the present invention. FIG. 16 is somewhat similar to FIG. 1, as device 1' includes rotating handle assemblies 40', an upper housing 10', a lower housing 20' and a central cavity for receiving a plurality of plates 300'. Upper housing 10' may have a raised door 13, which may be embodied as a frosted or clear plastic panel, for example. The user may view a suitable indicator such as label 103 (not shown) depicting how much weight is in the device 1'. The raised door 13 may be held by spring force which may be overcome by the user pressing down against door 13 to overcome spring pressure, similar to how one might open a cassette housing of a cassette recorder or hand held VHS recorder, for example to open the door 13.

Device 1' may include a weight selector assembly which may comprise a selector knob 101' and a selector tube 120'. Selector tube 120' may include a plurality of vertically arranged teeth 122' thereon for engaging teeth 122' within corresponding slots 312' of weight plates 300'. The weight selector assembly may slide laterally to align teeth 122' with corresponding slots 312' of given weight plates 300' to engage the desired amount of weight plates 300' that have been selected based on the lateral movement of the weight selector assembly by a user of the device 1'. There may be provided calibrations on one or more of the weight plates 300' that tells the user where to align the selector knob 101'. This may be seen through the clear door 13, for example, and may be in equal weight increments, for example.

Accordingly, to pick-up weight the selector tube 120' may extend through the slots 312' as the weight loads from the bottom of device 1' through lower housing 20' and is received into a cavity somewhat similar to as shown in FIG. 1. However, the weights are selected by lateral movement of the weight selector mechanism to lockingly engage teeth 122' with slots 312', as shown in FIG. 16. Once the desired weight is selected, door 13 may be closed. The closing action of the door 13 may pull the selected weight plates 300' up slightly in a compressive engagement to limit movement of the weight plates 300' therein. Door 13 also provides a locking mechanism for device 1'.

Weight plates 300' may be configured in several configurations, one of which may be known as a 'clamshell' arrangement. Widthwise, the width of the weight plates 300' may increase from bottom to top so as to provide individual weight plates 300' of equal weight which, when engaged by teeth 122' and secured in device 1', may maintain the center of gravity of device 1' generally in the middle of the device 1', not top heavy or bottom heavy, regardless of which weight plates 300' are selected.

Although not shown for reasons of clarity, the individual weight plates 300' may be of different thicknesses and dimensions so as to provide an equal weight for each weight plate 300'. The weight plates 300' may be configured so that they are stackable in a general vertical orientation, as shown in FIG. 16. Further, each slot 312' may include teeth (not shown). The teeth may be arranged along different locations in slots 312' of different weight plates 300', so that teeth 122' may engage corresponding teeth of a given weight plate 300' based on the position of selector knob 101'.

Each weight plate 300' may have one or more openings (not shown for reasons of clarity) other than central opening 312'. Openings may be different for different weight plates 300', depending on the vertical position of a given weight plate 300' in the stack shown in FIG. 16, for example. Each weight plate 300' may further have a different stamping to accommodate weight plates 300' having equal overall weight, for example.

Referring again to FIG. 16, selector knob 101' may traverses laterally along a guide plate 156 based on actuation by the user. Optionally, guide plate 156 may include a plurality of spaced detents or indicators that may represented a selected weight by the user. The selector knob may include a tab (not shown) that engages a given detent to maintain selector knob 101' at the selected position on guide plate 156. Depending on the weight selected, the teeth 122' of selector tube 120' may thus be aligned within slots 312' of the weight plates 300' so as to engage corresponding teeth of one or more weight plates 300', for example.

In general, individual components of the exercise device 1' described herein may be fabricated primarily from moldable lightweight materials such as ABS. The weight plates 300' may be stamped from hot-rolled steel, cut from cold-rolled steel, stamped from a stainless steel alloy, formed of cast metals or machined metals, or formed by a process using heavy filler materials such as concrete or soft lead in a molded or formed outer housing. A basic requirement is that the weights 300' be formed of a strong enough material that the teeth are sufficiently durable and at a reasonably accurate enough location on the associated weight plate 300' to successfully engage teeth 122' of the ' selector tube 120'. The rotating handle assemblies 40 may be composed of material and formed as described in the previous exemplary embodiment, for example.

Accordingly, the teeth of a given weight plate 300' placed at different points in each opening 312' enables the teeth 122' of the selector tube 120' to engage a given weight plate 300' based on the lateral movement of the selector knob 101' and sector tube 120' during the weight selection process. A weight plate 300' orientation of a given plate 300' may be such that each weight plate 300' weighs the same and maintains the center of gravity of the device 1' when secured within the device 1' by the closing action of the door 13. Door 13 provides a locking mechanism using spring force to secure the individual weight plates 300' within the device 1', substantially eliminating the potential for vibration within the device 1'.

Figure 17:
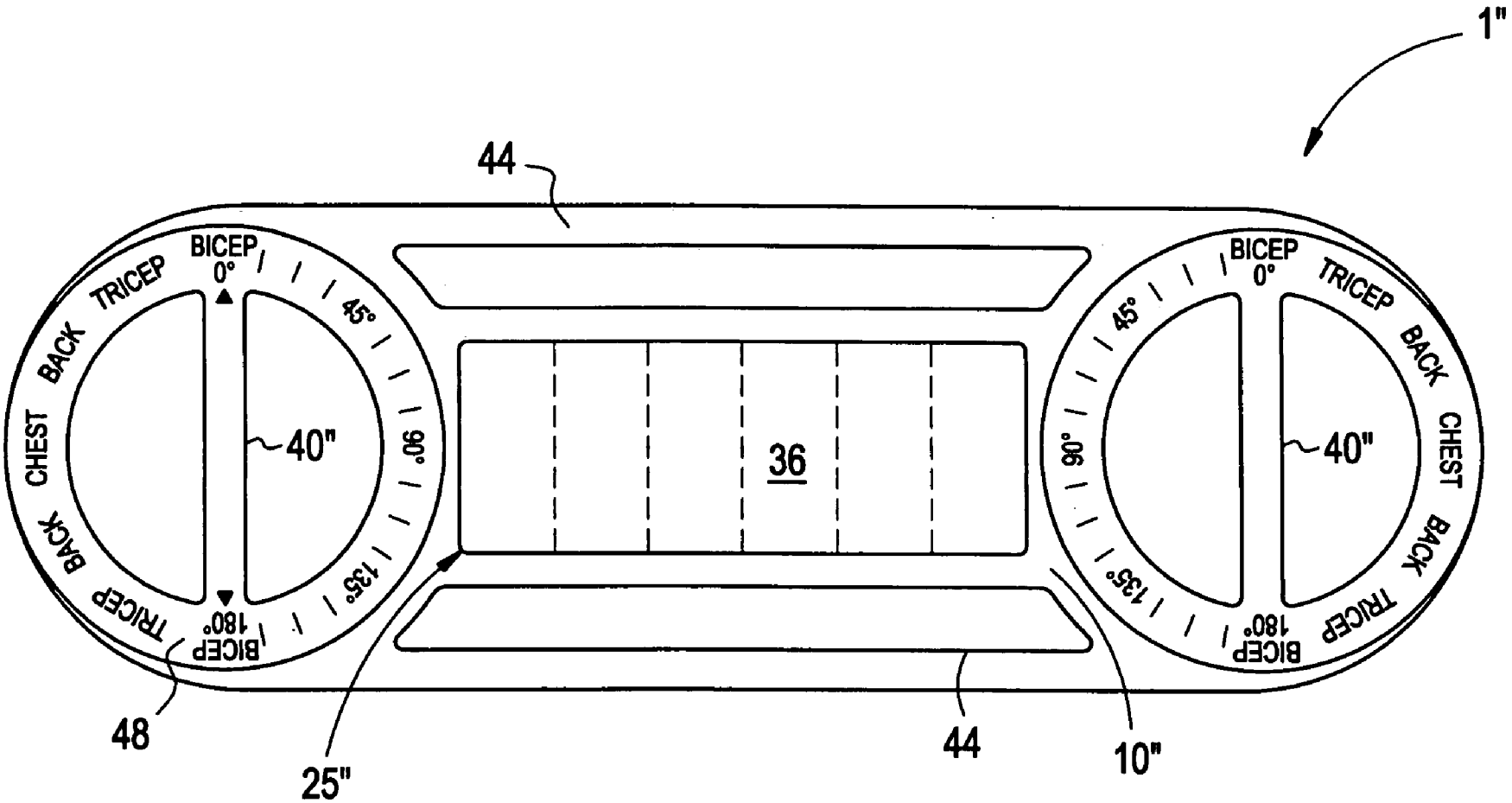
FIG. 17 is a top view of an exercise device in accordance with another exemplary embodiment of the present invention.

FIG. 17 is a top view of an exercise device in accordance with another exemplary embodiment of the present invention. Referring to FIG. 17, an exercise device 1" may include a housing 10" having a central cavity 25" containing a plurality of weight sleeves 36 and a pair of outboard rotating handle assemblies 40". Additionally, device 1" may include additional handles 44 that may be part of housing 10". Materials and processes for forming the components of device 1" may be as similar to those materials and processes as described above for the previous exemplary embodiments.

The weight sleeves 36 may each contain a removable weight 300" (not shown). For example, the weight sleeves 36 of cavity 25" may be configured to store weight between about 5–55 pounds, although this is merely an exemplary range of weight. Device 1" may further include one or more self-locking spring loaded-mechanisms (not shown for clarity) to secure the weights 300" in sleeves 36.

The rotating handles 40" may freely rotate to provide wrist supination (outward rotation) at a desired given angle. The handle assembles 40" may include a rotatable outer bezel 48 thereon that is calibrated to include a number of handle positions, here shown in terms of degrees from vertical. Positions of the handles may be selectable to exercise a specific muscle group (bicep, tricep, back chest, etc.) depending on the hand orientation of the user on the device 1". The user may thus select a free spinning or locked position of supination or pronation (inward rotation) of the wrist.

Device 1" may thus be a combination of a barbell, dumbbell and medicine ball. Unlike traditional barbells and dumbbells, weights may be attached centrally, as opposed to the ends. Slots (not shown) with locking mechanisms may be provided in the center of the device 1" for sleeves 36 of weights 300" to be installed. Based on the amount of weight installed, the weight load of device 1" may span over a range of weight, in upwards of a hundred pounds or more, for example.

Device 1" may have several alternative configurations, not illustrated herein for reasons of brevity. In an aspect, the device 1" may include a horizontal handle attached at either end with two shorter handles. The shorter horizontal handles may attach to two vertical handles, which in turn may connect to the lower housing 20" of the device 1". Inward of the vertical handles may be medicine ball equivalent sized grips that encapsulate either end of the weight slots. The weight slots may receive the sleeves 36 of weight. Further, the vertical handles may be extended at the bottom of device 1" to support exactly the same horizontal handle configuration as found on the top of the device 1". Accordingly, device 1" of FIG. 17 may include up to six horizontal handles, two short and one long handle on either side of device 1".

In another aspect, device 1" may include two removable, rotating handle assembly modules 40" that may be selectively attached to either end of the device 1". The handle assembly modules 40" may provide handholds that can be set to rotate freely clockwise/counter-clockwise, or which may be locked at any angle to work a desired muscle group. The handle assembly modules 40" may be adjustable inward and outward to allow a user to adjust the width of their hand holds as needed. The weight slots, horizontal handles and medicine ball grips may be similar to as described above.

Any of the exemplary exercise devices of FIGS. 1, 16 and 17 (devices 1, 1', 1"), may include a housing configured differently than as upper housing 10 and a lower housing 20. For example, the housing may be formed by an injection molded technique as one piece, as multiple pieces (>2) or from a modular connective construction (fixed housing with removable and/or reconfigurable connective modular housing portions), for example. Additionally, the cavity or opening may be provided on one of the exemplary devices in FIGS. 1, 16 and 17 in places other than centrally located within lower housing 20, as is evident to those having ordinary skill in the art.

Multiple alternative configurations providing an equivalent function may be substituted for, and//or may accompany, the weight selection assembly 100 described herein. For example, there may be provided various alternative structures for selecting weight other than the exemplary selector knob 101. Inner and outer selector tubes 110 and 120 may be replaced by several alternative structures, as would be evident to one having ordinary skill in the art. Alternatively, a single selector tube may be utilized in any of devices 1, 1', 1" instead of inner and outer selector tubes 110 and 120.

Figure 18:
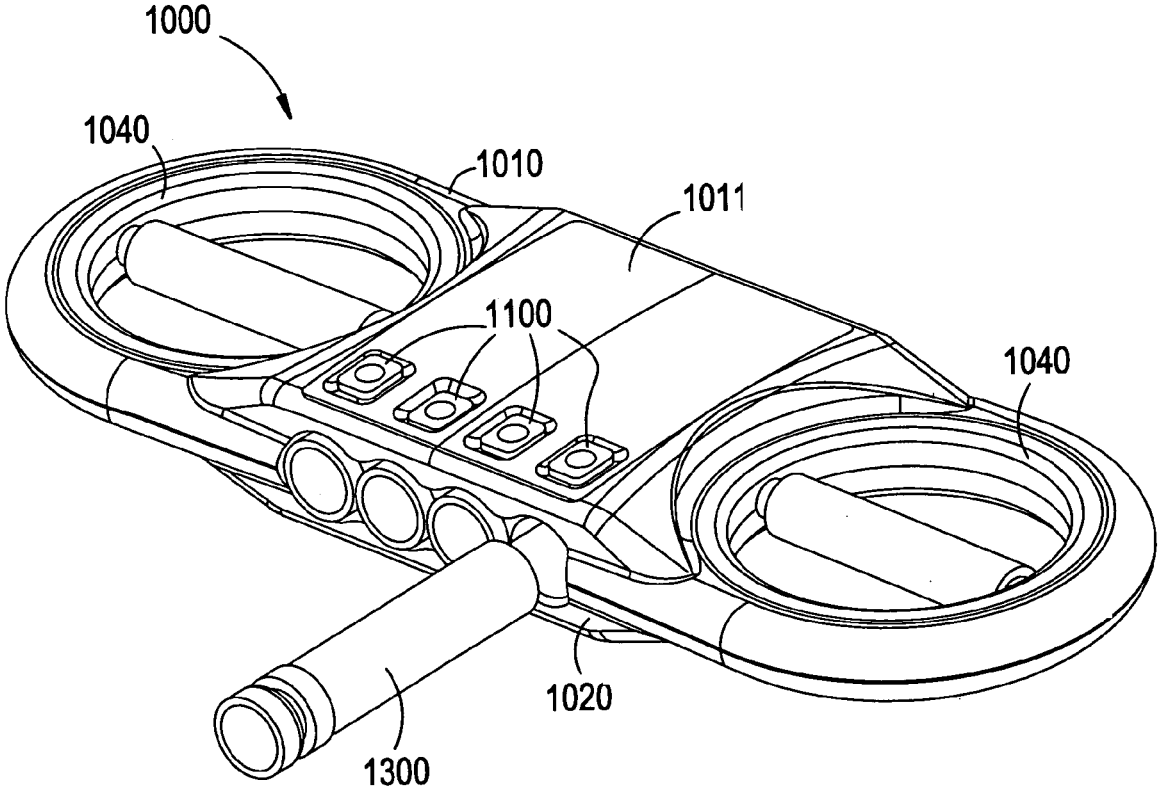
FIG. 18 is a plan view of an exercise device in accordance with another exemplary embodiment of the present invention.

FIG. 18 is a plan view of an exercise device in accordance with another exemplary embodiment of the present invention. FIG. 18 is somewhat similar to FIGS. 1, 16 and 17, as exercise device 1000 includes rotating handle assemblies 1040 and a housing assembly with a central cavity or opening 1025. The housing assembly of FIG. 18 may include an upper housing 1010 and a lower housing 1020. However, the housing assembly could be of singular construction formed by one of the forming processes described above with respect to FIG. 14, and of a material such as ABS or other material as described above with respect to FIG. 14, for example.

Cavity 1025 may be configured to receive a plurality of weights 1300. In FIG. 18, weights 1300 are shown in a tubular or a cylindrical slug form, it being understood that weights 300 can be configured of different geometrical shapes for insertion into cavity 1025. Although in this example only four (4) weights 1300 are shown, it is evident to those skilled in the art that device 1000 could be configured to accommodate fewer or greater than four weights 1300.

FIG. 18 also illustrates a weight release mechanism 1100 provided on an upper surface 1011 of the upper housing 1010 of device 1000. Weight release mechanism 1100 may be actuated by a user of the device 1000 so as to selectively release weights for removal from cavity 1025

Handle assemblies 1040 may be identical to the handle assemblies described with respect to FIGS. 10–13. For example, the device 1000 may include an element or device to create sound and resistance while the user actuates handle assemblies 1040. As previously discussed with respect to FIG. 12, the user may vary the sound and resistance created while actuating handle assembly 1040.

Handle assemblies 1040 may also include a rotatable outer bezel thereon with a number of handle positions, shown for example in FIG. 17 in terms of degrees from vertical. Positions of the handles may be selectable to exercise a specific muscle group (bicep, tricep, back, chest, etc.) depending on the hand orientation of the user on the device 1000. The user may thus select a free spinning or locked position of supination or pronation (inward rotation) of the wrist.

Handle assemblies 1040 may also be configured to provide directional movement other than rotational (lateral, transverse, etc.) for example. Further, handle assemblies 1040 may include other structural elements in lieu of teeth to engage a corresponding resistance/sound element, for example.

Figure 19:
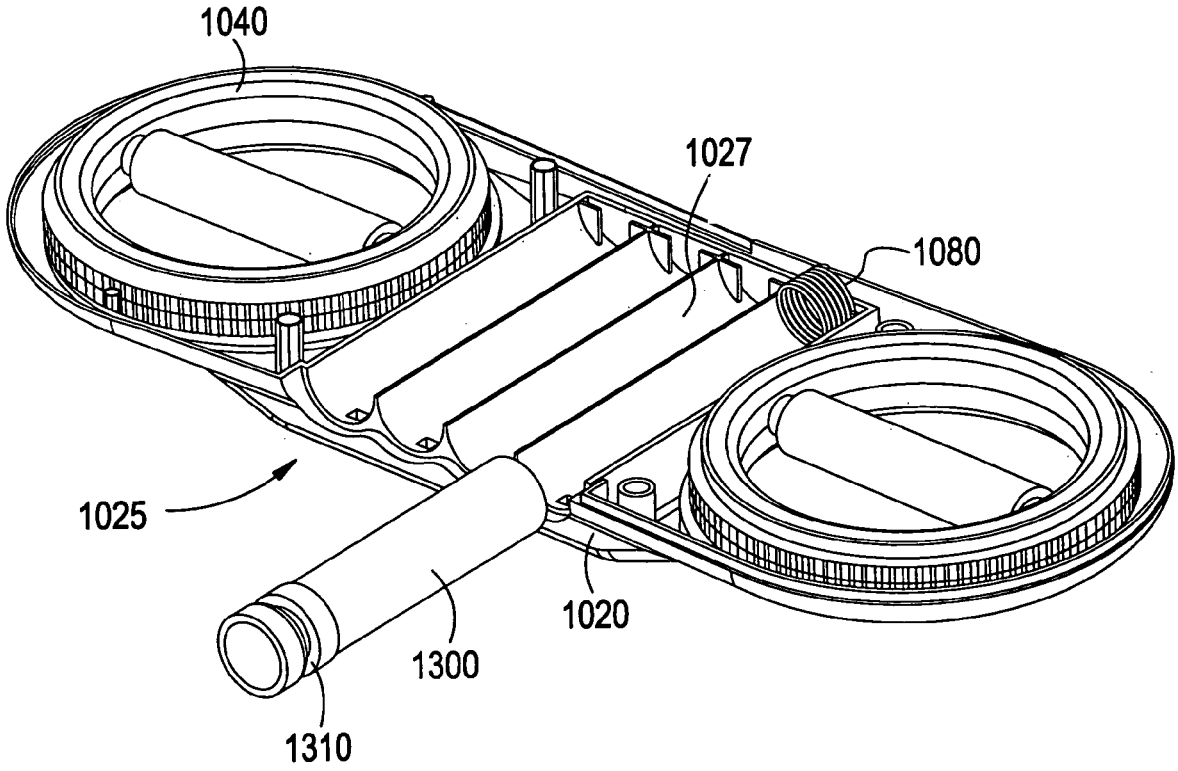
FIG. 19 is a cut-away view of the exercise device of FIG. 18 to illustrate the internal cavity and placement of weights therein.

FIG. 19 is a cut-away view of the exercise device of FIG. 18 to illustrate the internal cavity and placement of weights therein. Referring to FIG. 19, a given weight 1300 may be inserted into a corresponding guiding slot 1027 of cavity 1025. The weight 1300 may be inserted and locked into place within slot 1027 of the cavity 1025 via a latch assembly (not shown in FIG. 19). The latch assembly includes a latch hook (not shown) that engages a slotted recess 1310 of the weight 1300 as the weight 1300 is inserted, retaining the weight 1300 in place within the cavity 1025 as seated against a spring counter force, shown in FIG. 19 as coil 1030. A button (not shown in FIG. 19) may be depressed so that the latch hook is disengaged from slotted recess 1310. Once the latch hook is disengaged, the coil 1030 may provide an ejection function to at least partially eject the weight 1300 from its corresponding slot 1027 in cavity 1025.

Figure 20:
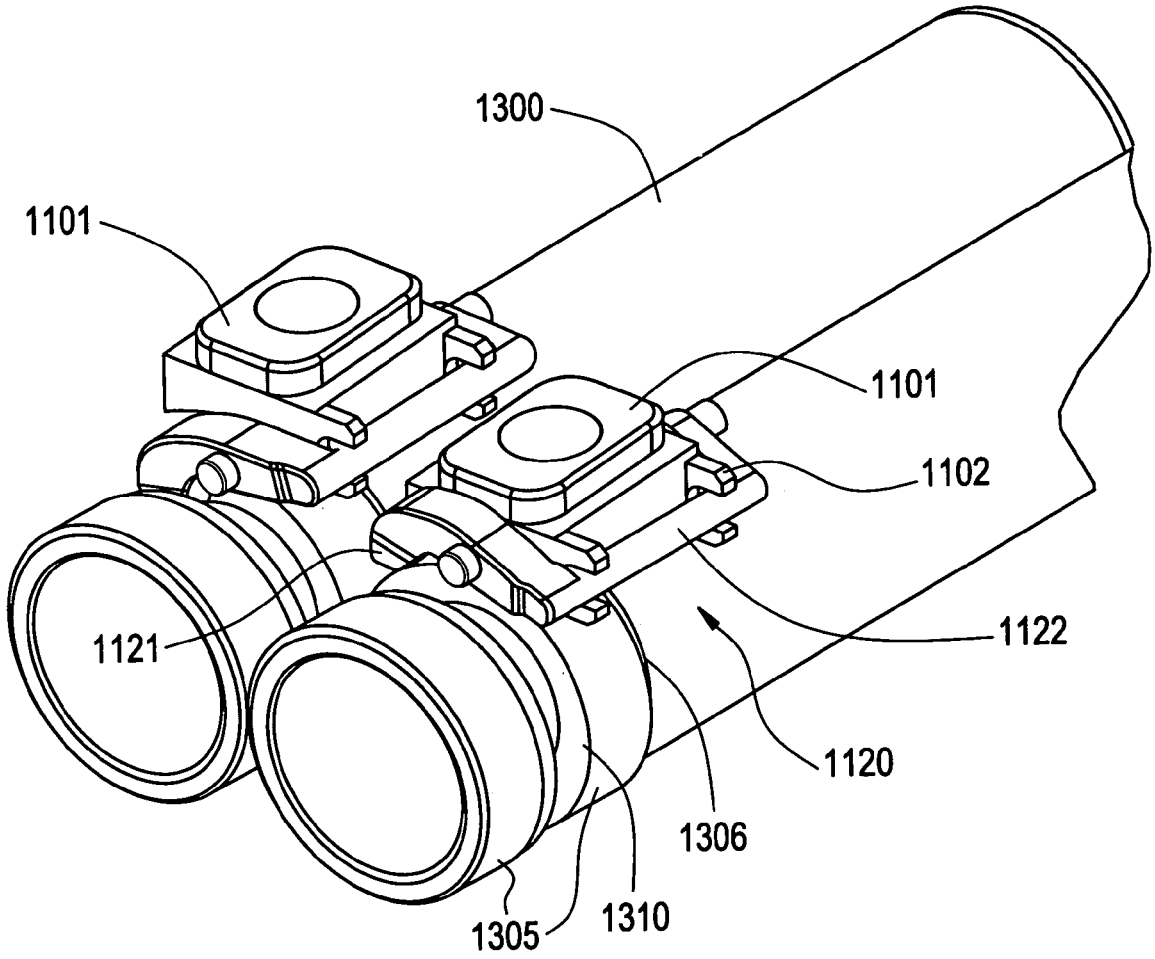
FIG. 20 is a magnified view of an exemplary weight release mechanism of the device of FIG. 18.
Figure 21:
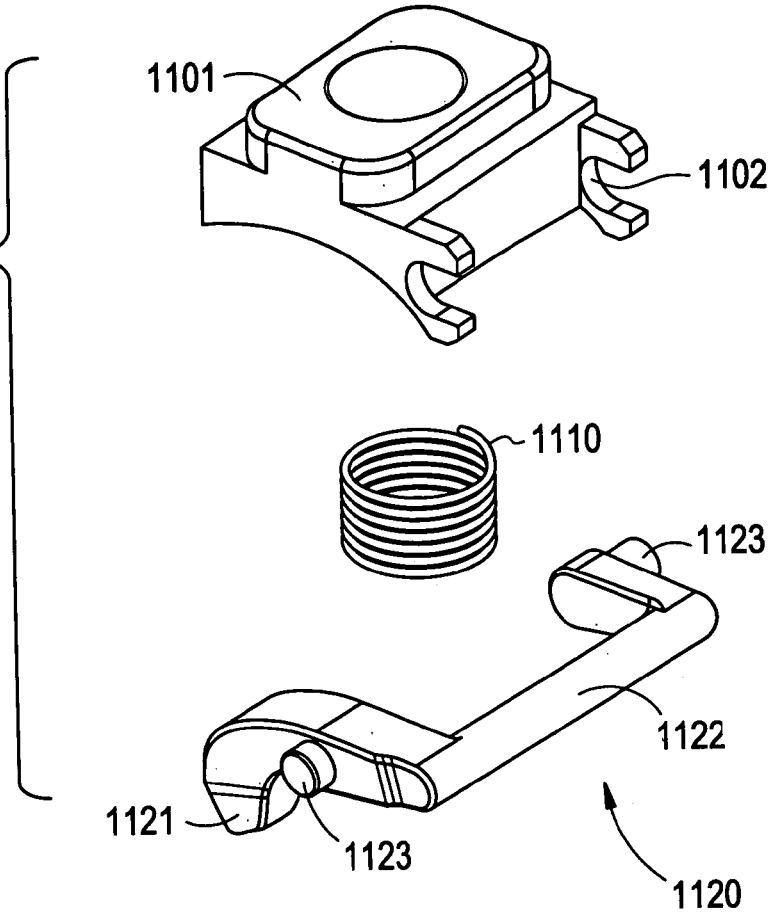
FIG. 21 is an exploded view illustrating parts of the weight release mechanism of FIG. 20 in further detail.

FIG. 20 is a magnified view of an exemplary weight release mechanism of the device of FIG. 18. FIG. 21 is an exploded view illustrating parts of the weight release mechanism of FIG. 20 in greater detail. In FIG. 20, weight release mechanism 1100 may include a button 1101 operatively connected to a button arm 1102, which in turn is connected to latch assembly 1120. Button arm 1102 may be in operative engagement with an axle element 1122 of latch assembly 1120. One end of latch assembly 1120 may terminate in a latch hook 1121. The latch hook 1121 may be configured for engagement with weight 1300. For example, latch hook 1121 may be configured for engagement within slotted recess 1310 of a weight 1300 to secure the weight 1300 within the corresponding slot 1027 of cavity 1025. Weight 1300 may include an end cap 1305 that covers an end thereof, including slotted recess 1310. End cap 1305 may be composed of a suitable plastic or rubber, formed so as to provide a sealing fit over the end of weight 1300, as shown in FIG. 20, for example.

Referring to FIG. 20, a user of the device 1000 may actuate button 1101 to disengage a removable weight 1300 form the device 1000. Button 1101 only needs to be depressed to disengage the weight 1300. This is because the end of the weight 1300 with the slotted recess 1310 includes a lead-in portion (shown generally at 1306) on an edge of cap 1305 thereof. The lead-in portion 1306 actuates a tapered edge on the latch hook 1121 such that the latch hook 1121 automatically "kicks over" the end cap 1305 to engage or seat within slotted recess 1310 as the weight 1300 is inserted. This is possible since the latch hook 1121 has sufficient "give" of play so as to allow the insertion action of the weight 1300 into slot 1027, yet secures the weight 1300 therein once latch hook 1121 seats in slotted recess 1310. Thus, the interaction of latch hook 1121 with the end cap 1305 and slotted recess 1310 as the weight 1300 is inserted in a slot 1027 of the cavity 1025 may represent a securing and/or engaging means for securing the weight 1300 therein.

Referring now to FIG. 21, the button 1101 actuates axle element 1122 of latch assembly 1120 via button arms 1102. Latch assembly 1120 may be mounted via stub axles 1123 to a portion of upper housing 1010 (not shown for clarity). The movement of button arms 1102 causes corresponding translational movement of axle element 1122. Stub axles 1123 translate this movement to impart rotational movement of the latch hook 1121. This enables latch hook 1121 to rotate into engagement with slotted recess 1310 of weight 1300, or out of engagement with slotted recess 1310. To assist the latch hook 1121 engagement with slotted recess 1310, a spring 110 may be mounted beneath button 1102 to provide tension on latch hook 1121, for example.

The weight release mechanism 1100 and its constituent parts may be molded of plastics and/or metals. For example, button 1101 and arms 1102 may be formed by an injection molding process from a high impact plastic such as ABS. Latch assembly 1120 may also be formed of injection molded ABS. However, parts of latch assembly 1120 may require additional strength. Due to the loads on the latch assembly 1120, one or more of the latch hook 1121, axle element 1122 and stub axles 1123 may be molded of a more durable material than ABS, such as glass-filled nylon, or any material having similar fracture toughness characteristics to glass-filled nylon, for example.

Figure 22:
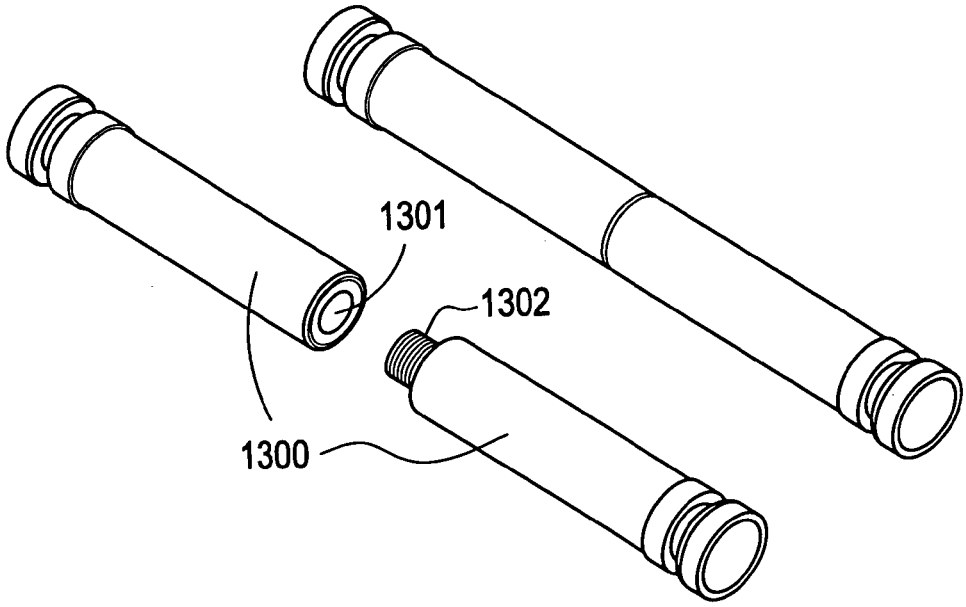
FIG. 22 is a perspective view illustrating exemplary weights for the device of FIG. 18.

FIG. 22 is a perspective view illustrating exemplary weights for the device of FIG. 18. The weights 1300 may be formed from hot or cold-rolled steel using any suitable forming process so as to obtain a weight 1300 with a shape that conforms to the dimensions of a corresponding slot 1027 within cavity 1025.

The weight 1300 may be formed of any ferrous or non-ferrous metal, depending upon desired weight characteristics. The metal could be cast or machined, for example. Other materials or compositions may be used, especially if another material is used to provide a rigid structure. For example, a hollow tube could be provided that is filled with sand, lead shot, concrete, a fluid, etc. The tube could be formed of metal, molded plastic, or composite material, for example. A rigid material could be applied on the outside of the tube to provide a stable shape and an accurate means of engaging latch assembly 1120. Those skilled in the art may of course envision a plurality of possible material combinations that would provide a desired mass and/or structural characteristics.

Additional materials can be provided at given outside regions of weight 1300 to provide grip or comfort for a user's hand. These may include soft plastic or rubber compounds. Additional decorative elements can be provided on the end of weight 1300 so that as the weight is inserted into cavity 1025, it improves the appearance of the overall device 1000. These decorative elements could be formed of plastic, metal, rubber or polymer foam, for example.

Referring to FIG. 22, the exercise device 1000 may be configured so as to accommodate weights 1300 having both a female end 1301 and a male end 1302. Either the female end 1301 or male end 1302 could be inserted into cavity 1025 so as to rest against coil 1080 of FIG. 19, for example. In the example of FIG. 18, the device 100 may accommodate two 1-lb weights 1300 having female ends 1301 and two 1 lb weights 1300 having male ends 1302. A user of the device 1000 may thus connect two of the removable weights 1300 by engaging a male end 1302 to female end 1301 to realize a standalone hand weight of increased weight. The female and male ends 1301 and 1302 may be secured by a suitable attachment means including, but not limited to, threaded engagement of the ends, a spoke and socket arrangement (similar to a socket on a wrench), twist lock engagement, etc.

In the example of FIG. 22, the weights may be one (1) pound each. However, the maximum and minimum weights may vary; the exercise device 1000 could be adapted to hold different ranges of weights, depending on the desired size of the exercise device 1000 and desired accompanying weight. An exemplary range of weight may be between about at least 4 pounds (empty) to in excess of 100 pounds of weight, although conceivably the exercise device 1000 could be adapted to hold even greater amounts of weight.

Device 1000 and/or weights 1300 may be adapted for other uses than hand weights. For example, a weight 1300 may be configured for attachment to a hiking stick, ski pole, an ankle/wrist band device with plural sockets to accept more than one weight. In another variant, device 1000 may be provided with attachment points thereon so it can be attached to a cable weight machine (such as a multi-station UNIVERSAL GYM®) type machine), for example, The attachment of device 1000 may thus provide a "weighted handle" for the cable machine, with the rotating handles 1040 possibly providing ergonomic benefits to the user.

Figure 23:
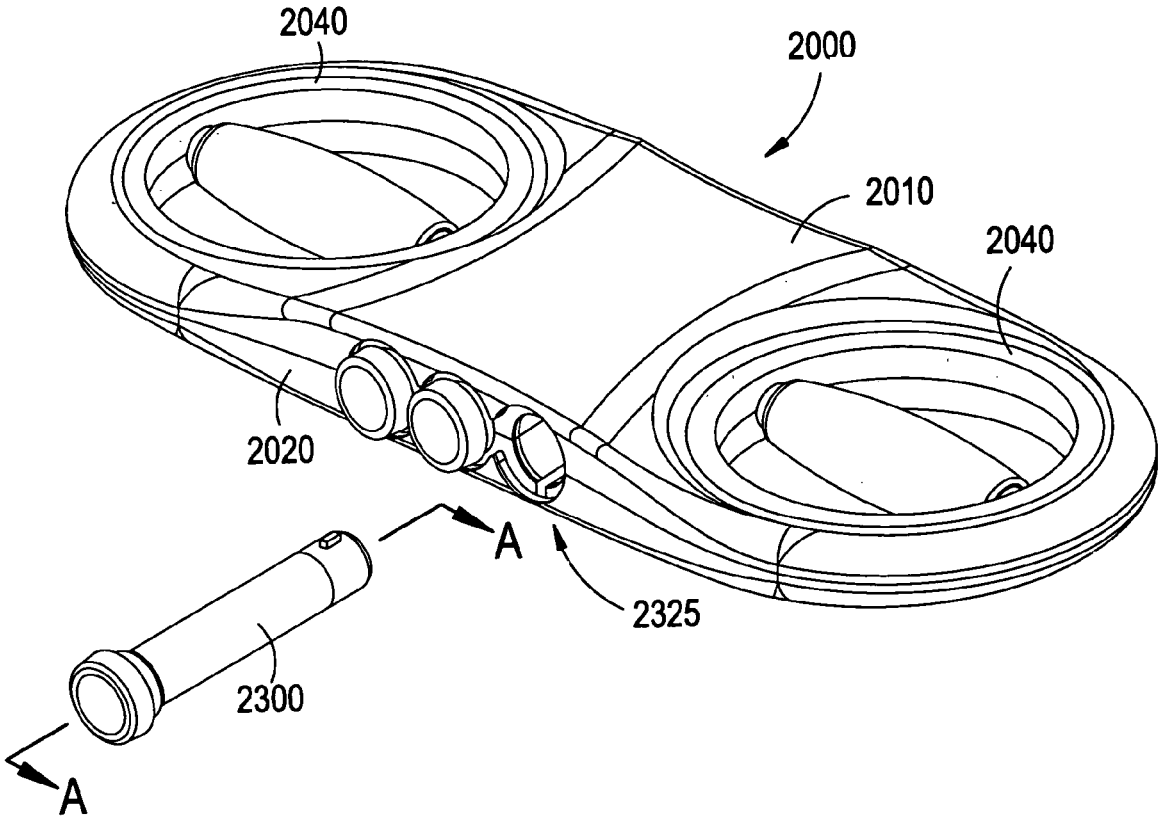
FIG. 23 is a plan view of an exercise device in accordance with another exemplary embodiment of the present invention.

FIG. 23 is a plan view of an exercise device in accordance with another exemplary embodiment of the present invention. FIG. 23 is somewhat similar to FIGS. 1 and 16–18, as the exercise device 1000 includes rotating handle assemblies 2040 and a housing with a central cavity or opening 2025. The housing may include an upper housing 2010 and a lower housing 2020; although it is evident to those of skill in the art that the housing could be of singular construction formed by one of the forming processes described above with respect to FIG. 14, i.e., formed of ABS or other material as previously described.

Cavity 2025 may be configured to receive a plurality of weights 2300. In FIG. 23, weights 2300 are shown in a tubular slug and/or a generally cylindrical shaped-form for lengthwise insertion into the cavity 2025 as shown in FIG. 23, it being understood that weights 2300 may be configured of different shapes for insertion into cavity 2025. Although in this example only three (3) weights 2300 are shown, it is evident to those skilled in the art that device 2000 could be configured to accommodate fewer or greater than three weights 2300. Hereafter, a weight 2300 may occasionally be referred to as a weight assembly 2300' to illustrate the components that constitute a given weight 2300.

The cavity 2025 may include a plurality of weights sockets 2105, as generally shown in FIG. 23. Each weight socket 2105 may be configured for retaining a corresponding weight therein via a "twist lock" feature of the exercise device 2000. For example, a given weight 2300 may be secured within a corresponding weight socket 2105 by rotating the weight 2300 in a first direction (counter-clockwise or clockwise) as the weight 2300 is being inserted into the weight socket 2105. In an aspect, the weight socket 2105 includes features and/or components that facilitate weight 2300 rotation into a locked position within socket 2105. The weight 2300 may be fully removed from the weight socket 2105 simply by rotating the weight 2300 in a rotation direction opposite to the first direction. An exercise device (such as device 2000) employing the aforementioned twist lock feature may eliminate the need for separate latch mechanisms and buttons, as described in the exemplary embodiments of FIGS. 18–22. This may result in fewer moving parts and a sleeker overall design for the exercise device 2000.

Figure 24:
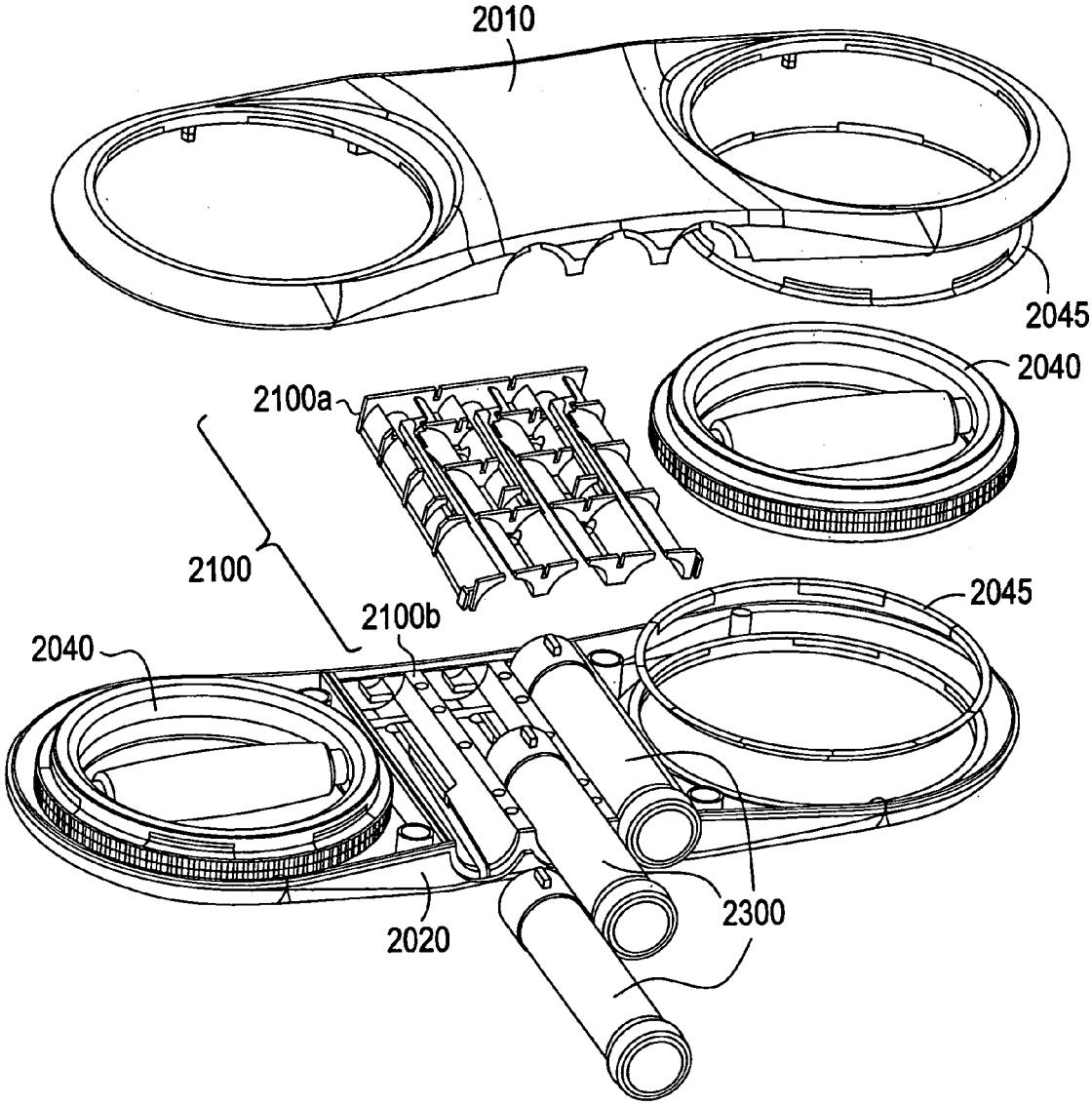
FIG. 24 is an exploded view illustrating parts of the exercise device of FIG. 23 in further detail.

FIG. 24 is an exploded view illustrating parts of the exercise device of FIG. 23 in further detail. The weight sockets 2105 may be formed as part of a weight retainer assembly 2100. The weight retainer assembly 2100 may be composed of upper and lower weight retainer halves 2100*a* and 2100*b*, although it would be evident to one skilled in the art that weight retainer assembly 2100 could be injection molded as a single piece construction. Weight retainers 2100*a* and 2100*b* may be formed by an injection molding process from a high impact plastic, such as ABS or other equivalent thermoplastic and/or thermoset materials that have characteristics similar to ABS, such as talc-filled polypropylene, high strength polycarbonates such as GE LEXAN®, blended plastics, etc., which may be used instead of or in addition to ABS.

Handle assemblies 2040 may be substantially identical to the handle assemblies described with respect to FIGS. 10–13. In addition, bearing washers 2045 may be provided on each side of handle assemblies 2040, as shown in FIG. 24. The bearing washers 2045 may aid in establishing desired turning resistance for handle assemblies 2040 and may help absorb manufacturing tolerances in the clearance between upper housing 2010 and lower housing 2020.

As previously described, the exercise device 2000 may include a resistance/sound element device to create sound and resistance while the user actuates handle assemblies 2040, such as is shown in FIG. 12. Handle assemblies 2040 may also include the rotatable outer bezel with handle positions (FIG. 17) that may be selectable to exercise a specific muscle group, depending on the hand orientation of the user on the device 2000. Handle assemblies 1040 may also be configured to provide directional movement other than rotational (lateral, transverse, etc.) for example, and may include other structural elements in lieu of teeth to engage a corresponding resistance/sound element, for example.

Figure 25:
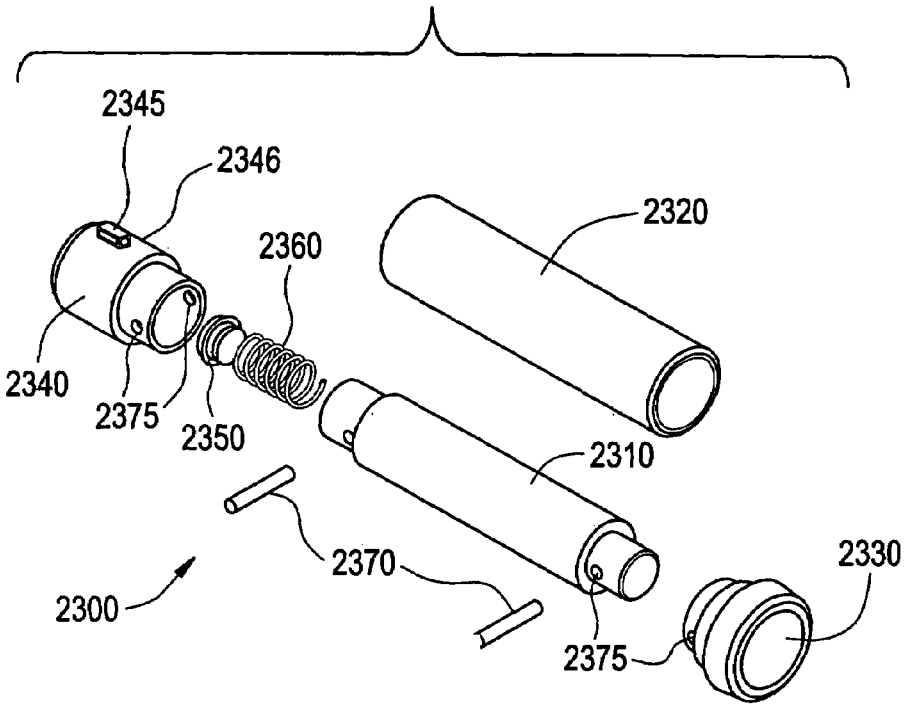
FIG. 25 is an exploded view illustrating parts of an exemplary weight in further detail.

FIG. 25 is an exploded view illustrating parts of an exemplary weight in further detail. In FIG. 25, a weight assembly (weight) 2300 may be comprised of a weight element 2310 provided between end caps 2330 and 2340. Each weight assembly may weigh approximately 1.5 pounds and may be used as a separate hand weight when not being used in device 2300, for example. However, the weight of a given weight assembly 2300 may vary depending on the materials used for the weight element 2310, overall size of device 2000 and size of weight sockets 2105, etc. Weight element 2310 may be fabricated of steel rod steel in one embodiment, as a hollow plastic rod filled with lead to realize a 2–3 pound hand weight for example, by a plastic or metal material tube or cylinder enclosing a solid material such as lead, sand, viscous liquid, etc., or by any other equivalent materials that provide a substantially solid weight segment 2310 between caps 2330, 2340.

Weight element 2310 may be surrounded by an outer rubberized grip 2320. Grip 2320 may be fabricated from a suitable soft material such as rubber, foam and the like, and may vary in its construction based upon factors such as comfort and durability. The shape of grip 2320 can be molded for maximum comfort or extruded to lower cost, as an example, so long as the weight assembly 2300 conforms to the inner diameter of a corresponding weight socket 2105.

End caps 2330 and 2340 may be made of a suitable hard plastic such as ABS, and may be provided for decorative and functional purposes. The end caps 2330, 2340 may be secured to weight element 2310 by a plurality of pins 2370 through tap holes 2375 during manufacture so as to realize the weight assembly 2300. End cap 2340 may be adapted to provide a function of guiding and locking weight assembly 2300 into exercise device 2000. For example, end cap 2340 may include one or more lugs 2345 (in an example, two may be provided on opposite sides of end cap 2340, lug 2345 on opposite side not shown in FIG. 25) that engage guide slots (not shown) in weight retainer assembly 2100. Faces 2346 of lugs 2345 may engage latches (not shown) provided in weight retainer assembly 2100.

As shown in FIG. 25, a plunger 2350 and spring 2360 may be provided within an interior of end cap 2340 so as to extend within a recessed portion (not shown) of weight element 2310. Plunger 2350 may cooperate with a spring 2360 to provide tension to the weight assembly 2300 while latched into the weight sockets 2105 of the weight retainer assembly 2100. For example, as the end of weight assembly 2300 at end cap 2340 is inserted into a weight socket 2105 toward the back of device 2000, the spring 2360 from within weight element 2310 provides a counter force on the plunger 2350 opposite a force applied against a face of the plunger 2350 from contact with a post (not shown) of the weight socket 2105. The spring tension provided by spring 2360 may prevent rattling and accidental release of weight assembly 2300 from the device 2000.

Figure 26:
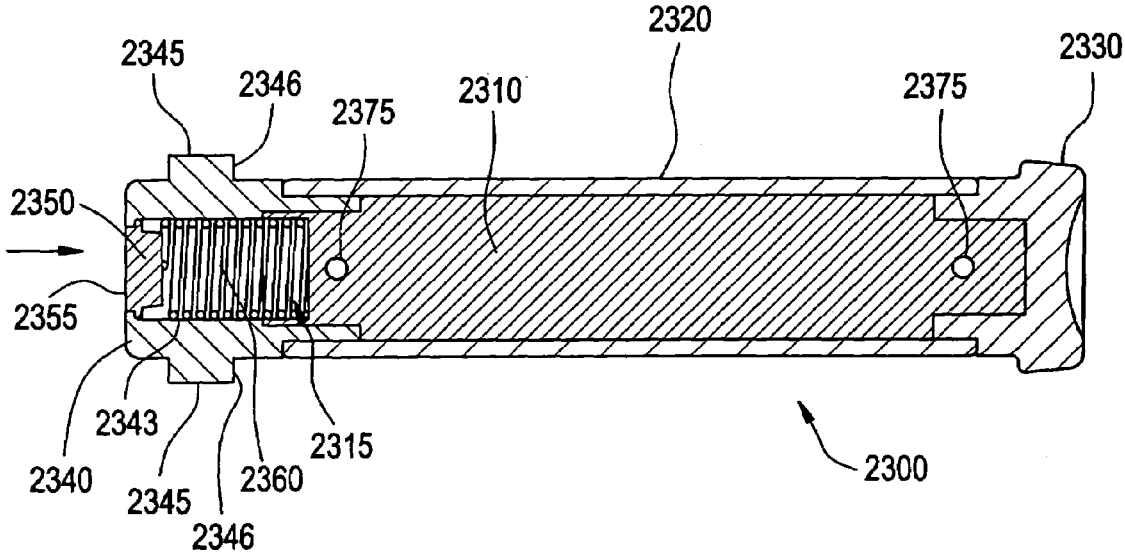
FIG. 26 is a cross-sectional view taken along line A—A in FIG. 23 to illustrate internals of the exemplary weight in further detail.

FIG. 26 is a cross-sectional view taken along line A—A in FIG. 23 to illustrate internal components of the exemplary weight in further detail. Additional details of weight assembly 2300 are shown in FIG. 26. The spring 2360 resides partially within a recessed portion 2315 of weight element 2310 and also partially within a central bore 2343 of end cap 2340, so as to provide tension against plunger 2350. Plunger 2350 has a face 2355 forming a face of the end cap 2340 that contacts a post within weight socket 2105 as the weight assembly 2300 is inserted fully against an inside end of the weight retainer assembly 2100. Both lugs 2345 with locking faces 2346 are also shown. Depressing plunger 2350 to the right (as shown by the arrow in FIG. 26) compresses spring 2360.

A user of the exercise device 2000 grasps end cap 2330 to twist and unlock weight assembly 2300 from exercise device 2000. As previously discussed, as the weight assembly 2300 is fully inserted and locked into position within a weight socket 2105 of retainer assembly 2100, the end cap 2330 protrudes slightly from a weight socket 2105 (see FIG. 23) and housings 2010–2020. This may provide a gripping surface for the user to rotate the weight assembly 2300 to an unlocked position for removal.

Figure 27:
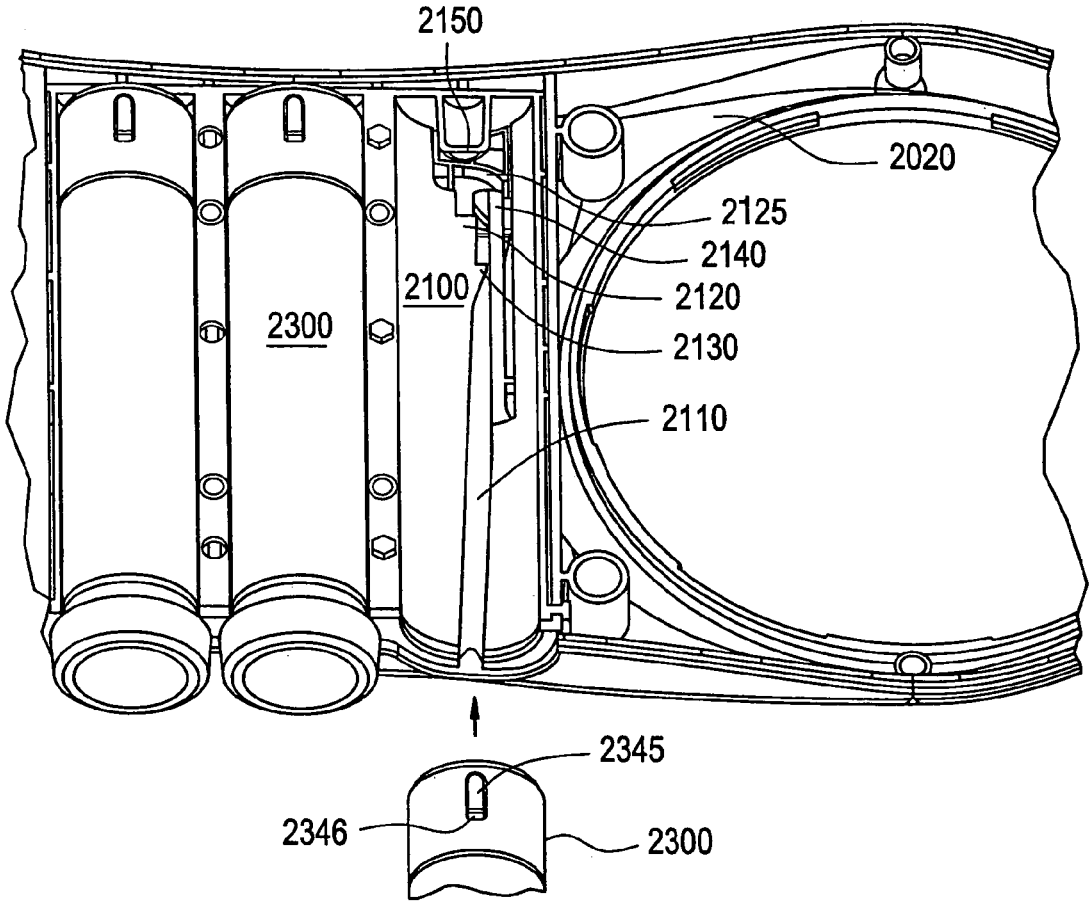
FIG. 27 is a magnified view of a portion of the exercise device to illustrate parts of the weight retainer assembly in further detail.

FIG. 27 is a magnified view of a portion of the exercise device to illustrate parts of the weight retainer assembly in further detail. Only one weight retainer (lower half 2100*b*) of lower housing 2020 is shown for reasons of clarity to illustrate further details therein, it being understood that weight retainer upper half 2100*a* of upper housing 2010 is essentially a mirror image of weight retainer half 2100*b*. FIG. 27 also shows a portion of a weight assembly 2300 at the end cap 2340 and direction of insertion (see arrow).

Referring to FIG. 27, lug 2345 may be guided by slot 2110 within the respective weight socket 2105 of the retainer assembly 2100. As the weight assembly 2300 is inserted into the weight socket 2105, lug 2345 initially encounters a secondary latch 2130. As the weight assembly 2300 is being inserted in the direction of the arrow, lug 2345 passes secondary latch 2130 and continues travel along guided slot 2110 until it reaches a primary latch 2120.

In addition to having the guide slot 2110 for receiving the lug 2345 at the open end of the weight socket 2105, the weight socket 2105 may be provided with rotation means for facilitating or encouraging rotation of the weight assembly 2300 in a given direction so that the lugs 2345 engage the primary latch 2120 as the weight assembly 2300 is inserted to substantially full insertion depth at the closed end within the weight socket 2105. As shown in FIG. 27, at full insertion depth rotation may be facilitated by lug 2345 contact with a flexible beam 2140 and a ramp element 2125. The flexible beam 2140 provides tension against lug 2345 to bear against end cap 2340 and then the side of weight element 2310 during insertion travel so as to provide a side force to encourage rotation of weight assembly 2300 until a face 2346 of the lug 2345 engages primary latch 2120. The ramp element 2125 is provided to further encourage and/or force rotation of weight assembly 2300 during a particularly rapid insertion event.

Although not shown, upper housing 2010 has a similar ramp element (not shown) that engages the opposite lug 2345 (not shown). All latching features described herein may be provided in two opposing retainer halves 2100*a/b* that engage both lugs 2345 of weight assembly 2300. Each of three weight sockets 2105 of the exemplary exercise device 2000 have these features.

Although direction of rotation in FIG. 27 for locking a weight assembly 2300 within a corresponding weight socket 2105 is shown as a counterclockwise rotation direction, due to the arrangement of ramp element 2125, flexible beam 2140 and latches 2120, 2130, the skilled artisan will recognize that locking could be effected by clockwise rotation of the weight assembly 2300 within weight socket 2105, simply by reversing positions and/or orientations of the ramp element 2125, flexible beam 2140 and latches 2120, 2130.

Upon full insertion of weight assembly 2300, a post 2150 depresses plunger 2350 to compress spring 2360 within the end cap 2340 and weight element 2310, providing tension to weight assembly 2300. This tension forces face 2346 of lug 2345 into continuous engagement with a face of the primary latch 2120. An additional benefit to this tension is the elimination of rattling noise during vigorous movement of exercise device 2000.

To remove weight assembly 2300, the user grasps the end cap 2330 and imparts a rotational twist in the opposite direction to uncouple face 2346 of lug 2345 from primary latch 2120. In the event that weight assembly 2300 accidentally or inadvertently disengages from primary latch 2120 (such as during a workout for example), face 2346 of lug 2345 will automatically engage a face of secondary latch 2130. Engagement is ensured by cross-tension applied from flexible beam 2140. This may prevent an unintended full release of weight assembly 2300. In order to fully release weight assembly 2300, the user grasps the end cap 2330 and twists weight assembly 2300 a second time to uncouple and/or disengage lug 2345 from secondary latch 2130.

Figure 28:
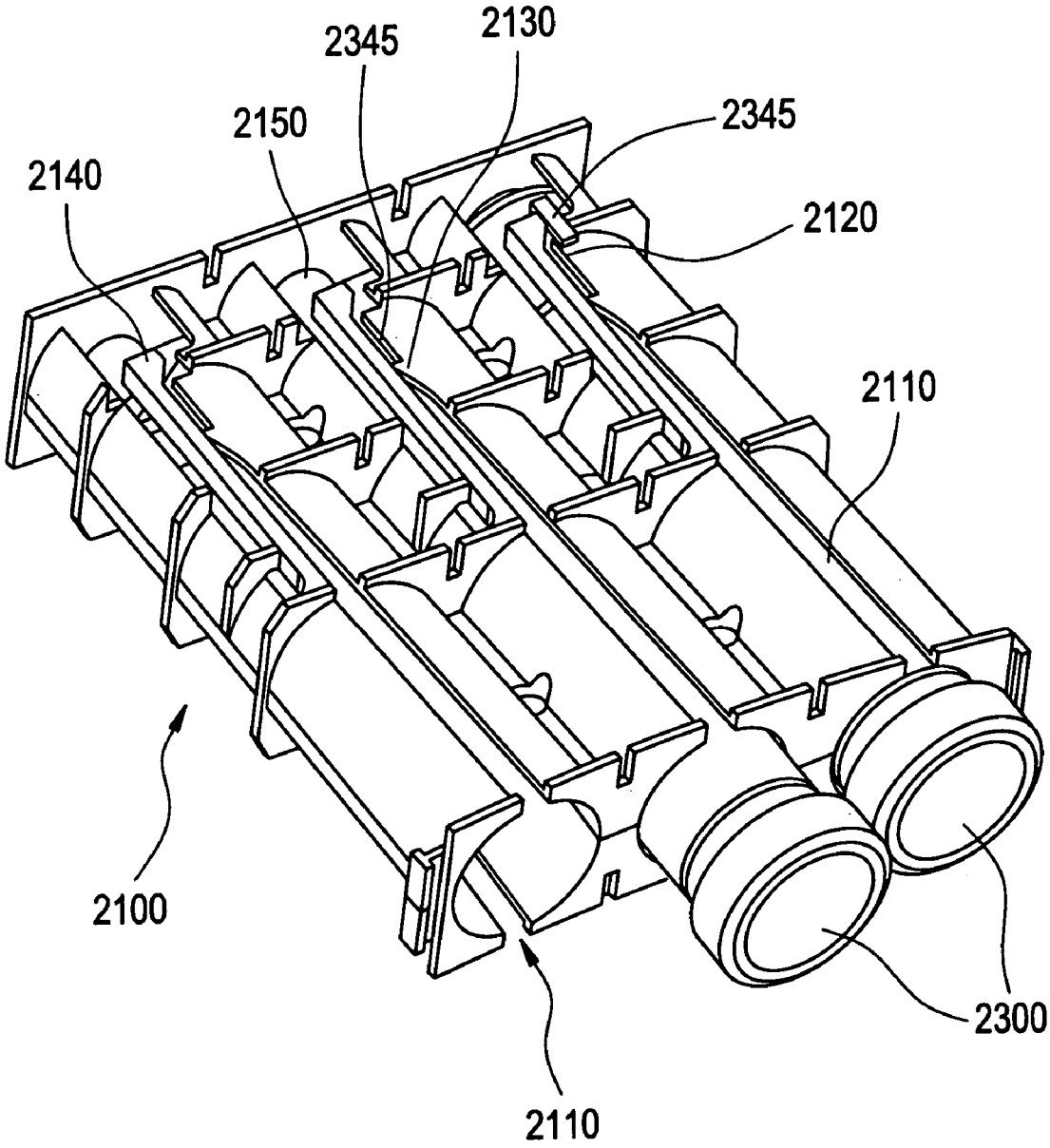
FIG. 28 is a plan view illustrating the weight retainer assembly of FIG. 23 in further detail.

FIG. 28 is a plan view illustrating the weight retainer assembly of FIG. 23 in further detail. The complete weight retainer assembly 2100 is shown in FIG. 28. The right-hand weight assembly 2300 is shown fully engaged onto a face of primary latch 2120. The middle weight assembly 2300 is shown being held in a partially released position by secondary latch 2130 (as in the case where one or both lugs 2345 inadvertently disengages from primary latches 2120. Since lugs 2345 and corresponding latch features are provide in both halves 2100*a/b*, redundant latching for the weight assembly 2300 may be provided.

Figure 29:
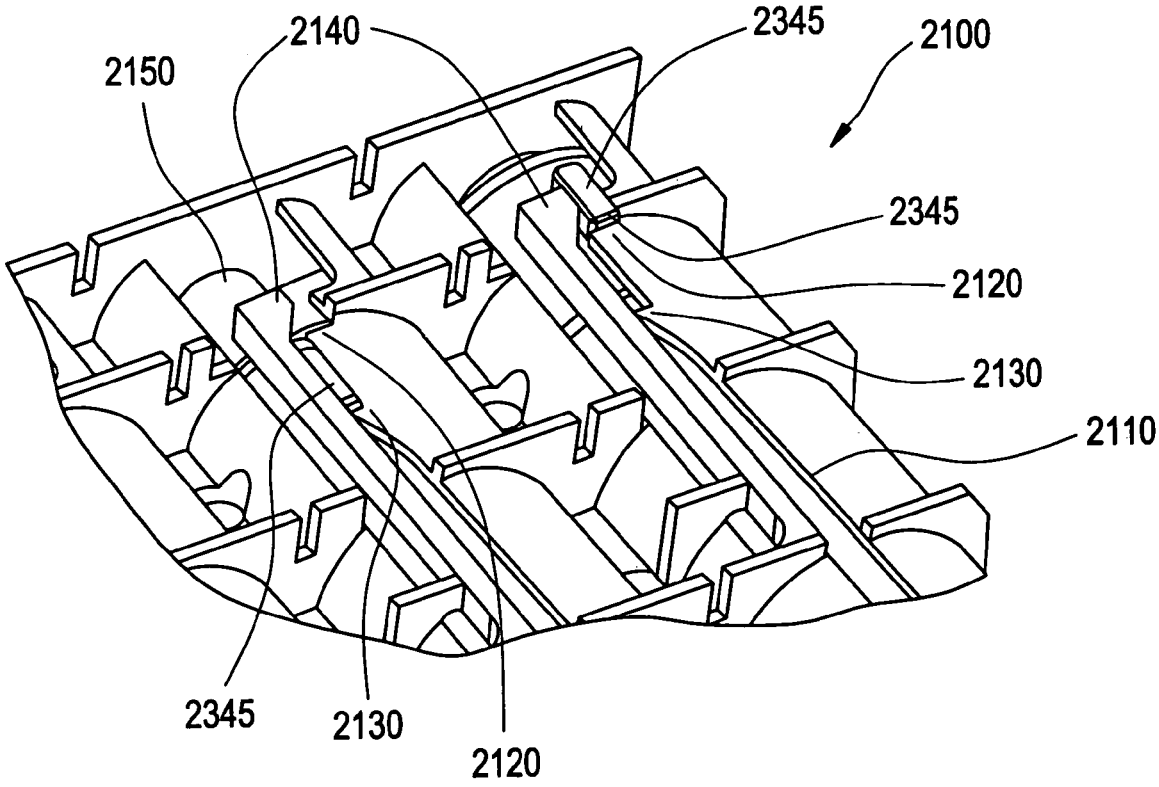
FIG. 29 is a magnified view of a portion of a weight retaining assembly to illustrate additional details thereof.

FIG. 29 is a magnified view of a portion of the weight retaining assembly 2100 to illustrate additional details. The right hand side weight assembly 2300 is at full insertion depth with post 2150 (not shown) depressing plunger 2350 within end cap 2340 against spring 2360, so as to continuously force face 2346 of lug 2345 into engagement with a face of primary latch 2120. The middle weight assembly 2300 is shown in the partially released position, held by secondary latch 2130. FIG. 29 show that clockwise rotation may be imparted to the weight assemblies to lock the weight assembly within weight socket 2105, as an alternative to the weight retainer assembly 2100 shown in FIG. 27.

The exemplary exercise devices described herein with centrally-loaded weights may substantially reflect or mimic the type of lifting people experience in real-world activities (where the person's hands are usually on the outside of the object being lifted), as compared to conventional barbells and dumbbells having symmetrical weights located outside the hands, which reflects a weight distribution that people almost never deal with in real world lifting activities. Moreover, the ease and rapidity of weight change in the exemplary exercise devices illustrates a substantial departure from the complexities of using adjustable dumbbells and/or the cost of having to purchase a reasonable weight range of fixed-weight dumbbells to achieve rapid weight change during a given workout session.

The exemplary embodiments of the present invention being thus described, it will be obvious that the same may be varied in many ways. Such variations are not to be regarded as departure from the spirit and scope of the exemplary embodiments of the present invention. All such modifications as would be obvious to one skilled in the art are intended to be included within the scope of the following claims.

What is claimed is:

1. An exercise device, comprising:

a housing;

a pair of rotatable handle assemblies within the housing; and a cavity within the housing for receiving one or more removable weights, the cavity further defined by a plurality of weight sockets in parallel relation to one another and centrally located within the housing, each weight socket configured for retaining a corresponding weight adapted for lengthwise insertion into and removal from its corresponding socket.

2. The device of claim 1, wherein each handle assembly of the pair is outboard the cavity on either side of the cavity.

3. The device of claim 1, wherein the weights are shaped in a generally tubular form for lengthwise insertion into its corresponding weight socket of the cavity.

4. The device of claim 1, wherein a given weight is secured within a corresponding weight socket by rotating the weight in a first direction during insertion of the given weight into the weight socket, and the given weight is fully removed from the weight socket by rotating the weight in a second direction.

5. The device of claim 1, wherein each weight includes a weight segment attached between first and second end caps, the first end cap adapted for insertion at an open end of the weight socket, the second end cap adapted so as to protrude from the housing at the weight socket open end when the weight is fully inserted into a closed end of the weight socket, the first end cap including at least one lug on a surface thereof, and each weight socket includes a guide slot for receiving the at least one lug at the open end, at least one latch, and rotation means for forcing rotation of the weight in a first direction so that the at least one lug engages the at least one latch upon insertion of the weight towards the closed end within the weight socket.

6. The device of claim 5, wherein the rotation means includes a flexible member providing tension against a face of the at least one lug as the weight is being inserted into the guide slot, and a ramp element provided at the closed end, the combination of the flexible member and ramp element imparting a force to cause the weight to rotate within the weight socket until the face of the at least one lug engages the at least one latch at the closed end of the weight socket.

7. The device of claim 5, wherein the weight segment further includes a recessed portion where the weight segment meets the first end cap and the first end cap includes a central bore therein containing a plunger and spring, the spring provided within the recessed portion and at least part of the bore for contacting the plunger, the plunger having a face that serves as a face of the first end cap, and each weight socket includes a post at the closed end that engages the plunger face when the weight is fully inserted, biasing the plunger against the spring so as to force the at least one lug into continuous engagement with the at least one latch.

8. The device of claim 5, wherein each weight includes a pair of lugs on opposing sides of the first end cap and each weight socket further includes a pair of primary latches for engaging a corresponding lug at the closed end and a pair of secondary latches, the secondary latches automatically engaging the opposing lugs upon accidental disengagement of the lugs from the primary latches to prevent unintended release of the weight from the weight socket.

9. The device of claim 5, wherein the means for removing includes the protruding second end cap, at least one lug and at least one latch, wherein an inserted weight is removed by rotating the protruding second end cap in a direction opposite the first direction so that the at least one lug disengages the at least one latch.

10. An exercise device, comprising:

a housing having first and second ends, a pair of rotatable handle assemblies within the housing, each handle assembly at a corresponding first end and second end of the housing, the housing adapted to secure a plurality of generally tubular-shaped weights, each insertable in a corresponding one of a plurality of weight sockets formed in the housing between the handle assemblies a given weight adapted to be rotated in a first direction for insertion and retention into its corresponding socket, and adapted to be rotated in a second direction of rotation opposite the first direction so as to remove the weight from its corresponding socket.

11. An exercise device, comprising:

a housing, a pair of rotatable handle assemblies within the housing, each handle assembly provided at a corresponding first end and second end of the housing; and a plurality of weight sockets centrally located in the housing between the handle assemblies, each weight socket having an open end and a closed end for receiving a corresponding weight adapted for lengthwise insertion into the socket, the weight to be retained within the socket at the closed end.

12. The device of claim 11, wherein a given weight is secured within a corresponding weight socket by rotating the weight in a first direction of rotation during insertion of the given weight into the weight socket, and the given weight is fully removed from the weight socket by rotating the weight in a direction different from the first direction.

13. The device of claim 11, wherein each weight includes at least one lug thereon, each weight socket includes at least one latch, the weight rotating in a first direction during insertion within a corresponding weight socket so that the at least one lug engages the at least one latch to secure the inserted weight within the weight socket, and the inserted weight is removed by rotating the weight in a second direction of rotation opposite the first direction so that the at least one lug disengages the at least one latch.

14. The device of claim 13, wherein a given weight socket includes rotation means for imparting a force to cause the weight to rotate within the socket until the least one lug engages the at least one latch.

15. The device of claim 13, wherein each weight includes an interior cavity containing a plunger and spring, and each weight socket includes a post that engages the plunger when the weight is fully inserted, biasing the plunger against the spring so as to force the at least one lug into continuous engagement with the at least one latch.

16. The device of claim 13, wherein each weight includes a pair of lugs on opposing sides of an end to be inserted into the socket, each weight socket further includes a pair of primary latches for engaging a corresponding lug and a pair of secondary latches, the secondary latches automatically engaging the opposing lugs upon accidental disengagement of the lugs from the primary latches to prevent unintended release of the weight from the weight socket.

17. The device of claim 1, wherein the handle assemblies rotate in the same plane into which the weights are insertable into the weight sockets.

18. The device of claim 10, wherein the handle assemblies rotate in the same plane into which the weights are insertable into the weight sockets.

19. The device of claim 11, wherein the handle assemblies rotate in the same plane into which the weights are insertable into the weight sockets.

* * * * *